US012135151B2

(12) United States Patent
Kent et al.

(10) Patent No.: US 12,135,151 B2
(45) Date of Patent: Nov. 5, 2024

(54) DUAL HEAT EXCHANGER FOR HEAT PUMP SYSTEM

(71) Applicant: MAHLE INTERNATIONAL GMBH, Stuttgart (DE)

(72) Inventors: Scott Kent, Albion, NY (US); Robert Louis Runk, Lockport, NY (US); Lindsey Lee Leitzel, Lockport, NY (US); Szymon Walczak, Ostrow-Wielkopolski (PL)

(73) Assignee: MAHLE INTERNATIONAL GMBH, Stuttgart (DE)

( * ) Notice: Subject to any disclaimer, the term of this patent is extended or adjusted under 35 U.S.C. 154(b) by 49 days.

(21) Appl. No.: 17/963,526

(22) Filed: Oct. 11, 2022

(65) Prior Publication Data

US 2024/0118005 A1 Apr. 11, 2024

(51) Int. Cl.
*F25B 39/02* (2006.01)
*F25B 30/02* (2006.01)

(52) U.S. Cl.
CPC ..... *F25B 39/02* (2013.01); *F25B 30/02* (2013.01)

(58) Field of Classification Search
CPC ..... F25B 39/02; F25B 30/02
See application file for complete search history.

(56) References Cited

U.S. PATENT DOCUMENTS 9,488,395 B2 11/2016 Matsumoto et al.
9,752,803 B2 9/2017 Matter, III et al.
2006/0243432 A1 11/2006 Demuth et al.
2009/0027671 A1 1/2009 Jarrell
2015/0107286 A1* 4/2015 Jin ..... F25B 13/00 62/324.6
2018/0135900 A1* 5/2018 Jindou ..... F28D 1/0435
(Continued)

FOREIGN PATENT DOCUMENTS

CN 103644685 3/2014
CN 107218822 9/2017
(Continued)

OTHER PUBLICATIONS

Pdf is translation of foreign reference CN 111322795 A (Year: 2020).*
(Continued)

*Primary Examiner* — Henry T Crenshaw
*Assistant Examiner* — Kamran Tavakoldavani
(74) *Attorney, Agent, or Firm* — Barnes & Thornburg LLP

(57) ABSTRACT

A heat exchanger for use in an outdoor environment with a heat pump system is provided. The heat exchanger includes a first set of tubes arranged in a parallel flow manner between a first manifold and a second manifold, wherein central straight portions of adjacent tubes are disposed with a space therebetween along each tube of the first set of tube between the first and second manifolds. A second set of tubes are arranged in a parallel flow manner between a third manifold and a fourth manifold, wherein central straight portions of adjacent tubes within the second set of tubes are at least partially disposed within the space between adjacent tubes of the first set of tubes. A fluid that flows through the first set of tubes additionally flows through the second set of tubes before the fluid returns to again flow through the first set of tubes.

28 Claims, 17 Drawing Sheets

(56) References Cited

U.S. PATENT DOCUMENTS

| | | | | |
|---|---|---|---|---|
| 2019/0049194 | A1 | 2/2019 | Yanik et al. | |
| 2020/0182564 | A1* | 6/2020 | Onaka | F28F 27/02 |
| 2020/0191501 | A1 | 6/2020 | Pelletier et al. | |
| 2022/0221226 | A1 | 7/2022 | Runk et al. | |
| 2022/0243989 | A1 | 8/2022 | Zhong et al. | |

FOREIGN PATENT DOCUMENTS

| | | | | | |
|---|---|---|---|---|---|
| CN | 109595951 | | | 4/2019 | |
| CN | 111322795 | | | 6/2020 | |
| CN | 111322795 | A | * | 6/2020 | F24F 13/30 |
| DE | 102012003526 | | | 8/2013 | |
| EP | 1762808 | | | 3/2007 | |
| EP | 1856500 | | | 11/2007 | |
| EP | 3798535 | | | 3/2021 | |
| FR | 2899959 | | | 10/2007 | |
| WO | 2004/074756 | | | 9/2004 | |
| WO | 2006/083511 | | | 8/2006 | |
| WO | 2012/112802 | | | 8/2012 | |
| WO | 2020/259671 | | | 12/2020 | |
| WO | 2021/250738 | | | 12/2021 | |

OTHER PUBLICATIONS

Search Report & Written Opinion issued in PCT/EP2023/074327 (Nov. 9, 2023).

* cited by examiner

DUAL HEAT EXCHANGER FOR HEAT PUMP SYSTEM

TECHNICAL FIELD

This disclosure relates to heat pump systems that are configured to allow for reversible flow and specifically to heat pump systems that are configured to operate in environments where the environmental temperature can be on the order of freezing or lower.

BRIEF SUMMARY

A first representative embodiment of the disclosure is provided. The embodiment includes a heat exchanger. The heat exchanger includes an assembly comprising a first set of tubes that are arranged in a parallel flow manner between a first manifold and a second manifold, wherein central straight portions of adjacent tubes within the first set of tubes are disposed with a space therebetween along each tube of the first set of tube between the first and second manifolds. The assembly comprises a second set of tubes that are arranged in a parallel flow manner between a third manifold and a fourth manifold, wherein central straight portions of adjacent tubes within the second set of tubes are at least partially disposed within the space between adjacent tubes of the first set of tubes. A fluid that flows through the first set of tubes additionally flows through the second set of tubes before the fluid returns to again flow through the first set of tubes.

Another representative embodiment of the disclosure is provided. The embodiment includes a heat exchange system. The heat exchange system includes a first heat exchange assembly that is configured to be disposed in an outdoor space configured for outside air to flow therethrough. The first heat exchange assembly includes a first set of tubes that are arranged in a parallel flow manner between a first manifold and a second manifold, wherein straight portions of adjacent tubes within the first set of tubes are disposed with a space therebetween along each tube of the first set of tube between the first and second manifolds. The first heat exchange assembly further comprises a second set of tubes that are arranged in a parallel flow manner from a third manifold to a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes. A second heat exchanger is disposed within an interior space, wherein an inlet of the second heat exchanger receives refrigerant that has flowed through both the first set of tubes and the second set of tubes, and an outlet of the second heat exchanger directs flow through the first and second set of tubes before the flow again returns to the second heat exchanger via the inlet. A compressor is disposed in the outdoor space, and an expansion valve is provided.

Advantages of the present disclosure will become more apparent to those skilled in the art from the following description of the preferred embodiments of the disclosure that have been shown and described by way of illustration. As will be realized, the disclosed subject matter is capable of other and different embodiments, and its details are capable of modification in various respects. Accordingly, the drawings and description are to be regarded as illustrative in nature and not as restrictive.

DETAILED DESCRIPTION OF THE PREFERRED EMBODIMENTS

Turning now to FIGS. 1-15*b* a heat exchange system 10 is provided. The heat exchange system 10 is configured to be operable in two different configurations, a first where a heat exchanger in an indoor environment provides cooling to the indoor environment (either by cooling a fluid that flows through the heat exchanger, or by cooling a space within the indoor environment) and a second where the heat exchanger in the indoor environment provides heat to the indoor environment (either by heating a fluid that flows through the heat exchanger, or by heating a space within the indoor environment. The system 10 therefore operates with the indoor heat exchanger operating as an evaporator when it is to provide cooling and a condenser when it is to provide heating.

Figure 6:
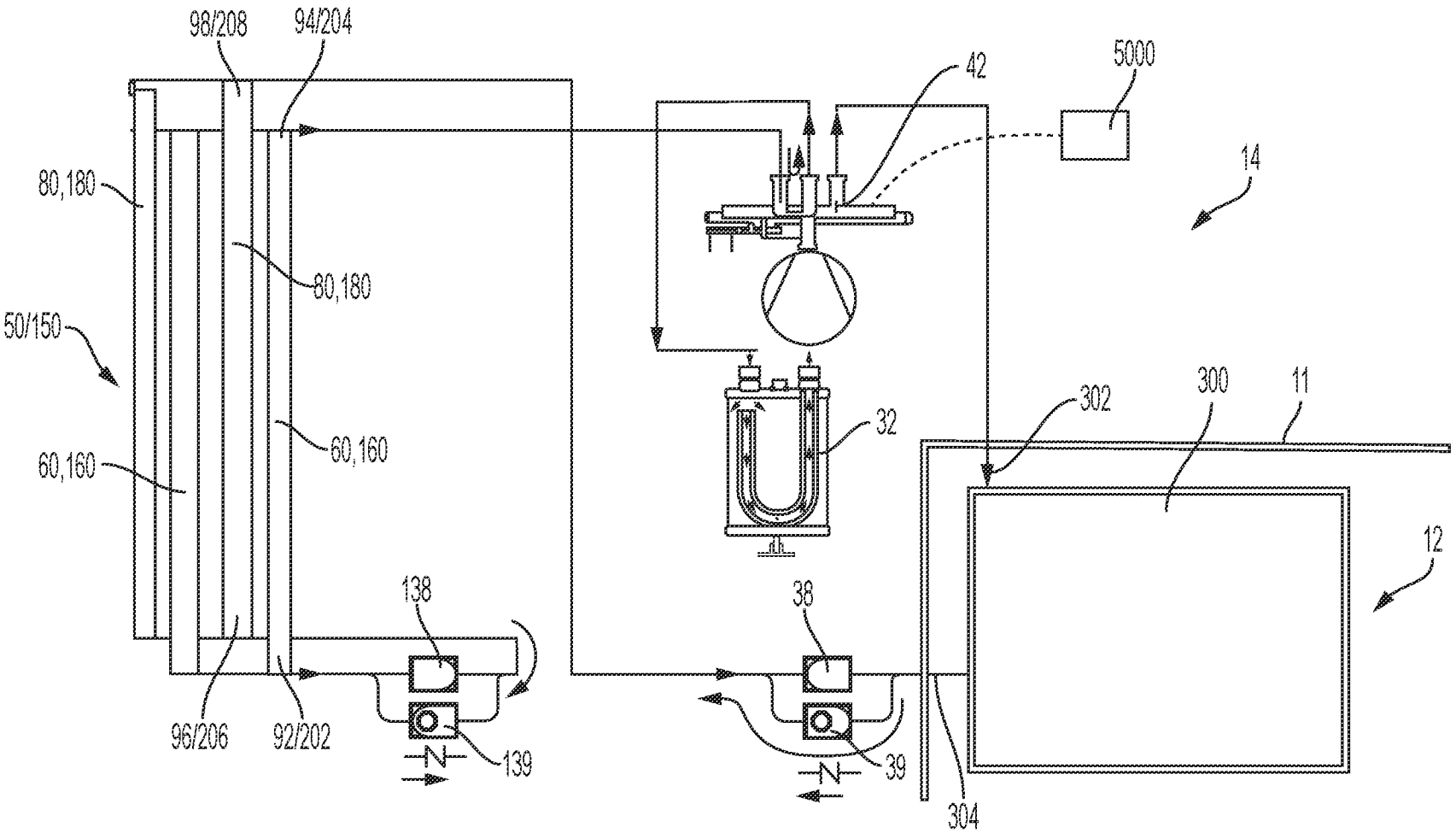
FIG. 6 is a schematic diagram of a heat pump system using a heat pump assembly of either of FIG. 1 or FIG. 2 in a heating mode.
Figure 7:
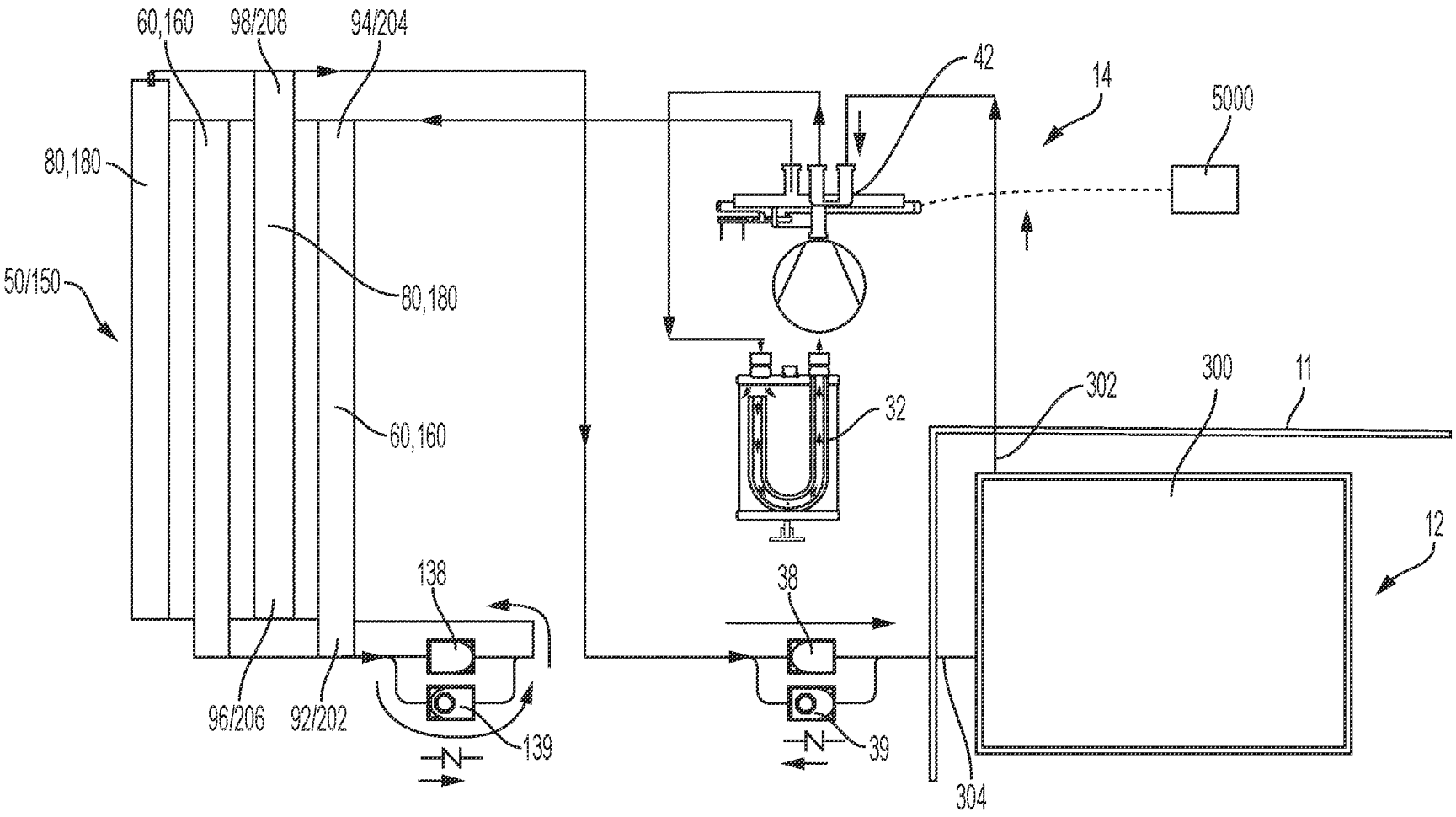
FIG. 7 is the schematic diagram of the heat pump system of FIG. 6 in a cooling mode.

The heat exchange system 10 is best understood with reference to FIGS. 6 and 7, which schematically depict a first representative embodiment of the heat exchange system in heating and cooling modes, respectively. The heat exchange system includes a heat exchanger 300 that is disposed within an indoor space 12—or in some embodiments a space that is desired to be conditioned by the system. In some embodiments, the indoor space 12 may be a space within an enclosed space that that includes one or more barriers between the inside space and the outside elements.

A second heat exchanger system 50, 150 is provided and is disposed within an outdoor space 14, or a space that fully or at least partially open the outside environment. (Different types of heat exchanger systems 50, 150 are discussed in detail below, each operates in the same manner as the second heat exchanger system otherwise described herein). The outdoor space 14 is provided to allow outside air, that is not fully, or in some embodiments is not at all subject to active cooling or heating, to serve as a heat source or a heat sink (depending upon the mode of operation of the system 10) to the second heat exchange system 50, 150. The system 10 further includes a compressor 32 and an expansion valve 38, 138, which both operate to allow the continuous heat cycle between the indoor space 20 and the outdoor space 22 as is well understood in the art. In some embodiments, the compressor 32 and the expansion valve 38, 183 may be provided in the outside environment.

Figure 1:
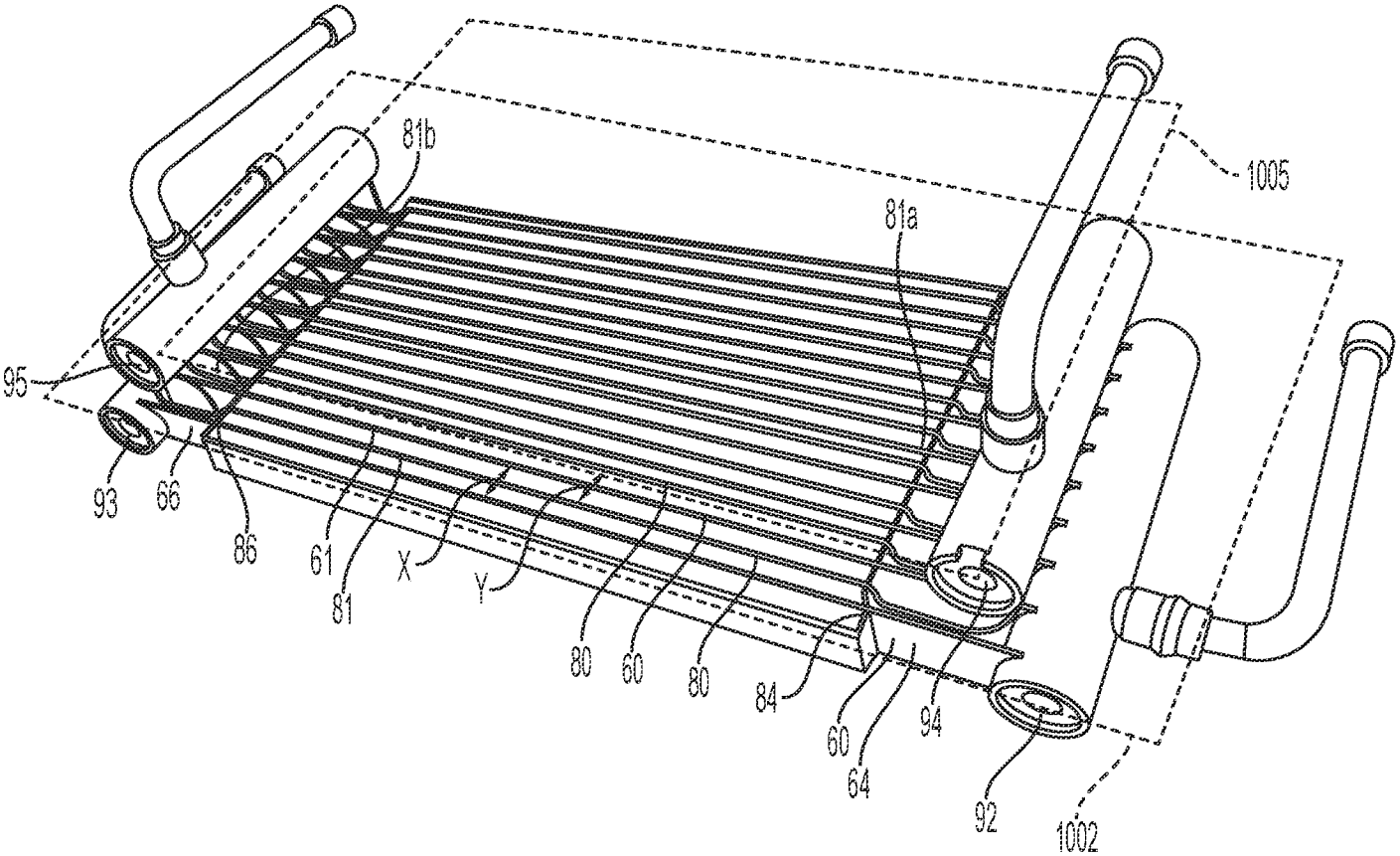
FIG. 1 is a perspective view of a heat exchange assembly for use in a heat pump assembly that can operate in a heating mode and a cooling mode.

A first embodiment of the second heat exchanger system 50 is provided and is depicted in FIG. 1 and a second embodiment of a second heat exchanger 150 is depicted in FIGS. 2-5. In both embodiments, the heat exchanger system 50/150 includes a plurality of first tubes 60/160 and a plurality of second tubes 80/180. The plurality of first tubes 60/60 and the plurality of second tubes 80/180 are fluidly disposed such that as refrigerant fluid flows through the system 10, the refrigerant flows through each of the plurality of first tubes 60/160 and the plurality of second tubes 80/160 before flowing through the indoor heat exchanger 300 in a cyclic fashion. In other words, refrigerant that flows out of the indoor heat exchanger 300 and reaches piping within the outdoor space 14 flows through each of the first set of tubes 60/160 and the second set of tubes 80/180 before returning to the indoor heat exchanger 300. Because the system 10 can operate in two operational modes (i.e. either to supply heat to the indoor heat exchanger 300 or to remove heat from the indoor heat exchanger 300) the path of flow through the first and second tubes 60/160, 80/180 varies with operations of the system, as will be discussed below.

In both the first and second embodiments, the plurality of first tubes 60/160 extend in the same direction and are disposed in a parallel and offset manner with respect to each other to extend from a first manifold 92 to a second manifold 94. The first tubes 60/160 are positioned with respect to each other such that the adjacent tubes within the first set of tubes establishes a space X therebetween along each tube between the first manifold 92 and the second manifold 94. Other aspects of the plurality of first tubes from each embodiment will be discussed in detail below.

In both the first and second embodiments, the plurality of second tubes 80/180 all extend in the same direction and are disposed in a parallel and offset manner with respect to each other to extend from a third manifold 96/206 to a fourth manifold 98/202. The second tubes 80/180 are positioned with respect to each other such that the adjacent tubes within the second set of tubes establishes a space Y therebetween along each tube between the third manifold 96 and the fourth manifold 98/202. A central portion 81/181 of each of the second tubes 80/180 are disposed within the space X between adjacent central portions 61/161 of adjacent first tubes 60/160. Wherein "each" tube as used herein with respect to both the first set of tubes 60/160 and the second set of tubes 80/180 is specifically defined herein to mean all of the respective tubes with the possible exception of the tube(s) 60/160 and/or tube(s) 80/180 that is the most outboard of the plurality of tubes, and establishes an outer tube within the heat exchange assembly 50/150. One of ordinary skill in the art will understand that for the two tubes that establish the outer tube within the heat exchange assembly, there will be no tubes that extend adjacent to that tube on the outer side of that tube and therefore the central portion of the outer tubes do not extend within a space between adjacent tubes of the other set of tubes. The term "each" includes all tubes that extend between two tubes of the opposite sets of tubes, and to include the two tubes that establish the outermost tube of the heating assembly 50/150, which are adjacent to the central portion of a tube from the other set of tubes.

The tubes 60/160 and 80/180 may be formed with different geometries and different cross-sections. In some embodiments, the tubes are formed with outer walls that establish a single lumen through which refrigerant flows therethrough. In other embodiments, the tubes 60/160 and 80/180 may include a plurality of parallel lumens 25, 24 (FIG. 5, also representative of tubes within heat exchanger 50) that are disposed therealong so that refrigerant flows in parallel and separated paths through the length of the tube 60/160 and 80/180, which maximizes a surface area of the tube within the combined lumens that is available to allow for heat to transfer from or to the fluid flowing within the tube within the heat exchange assembly 50/150. As will be readily understood by one of skill in the art with a thorough review of the subject specification, the number of and cross-sectional areas of the lumens through the tubes may be optimized to maximize the available heat transfer but minimize flow resistance through the tubes.

The tubes 60/160 and 80/180 may be approximately rectangular in cross-section, with left and right side surfaces and top and bottom side surfaces. The term approximately rectangular is used herein to include exactly rectangular (with planar sides that are at right angles with respect to each other) as well as to include shapes that have left and right surfaces (162/164, 182/184—tubes from the heat exchange system 50 are similar) with projections facing in the left and right direction that are wider than the projections that face in the upper (top side surface 166, 186) and lower (bottom side surface 168, 188) directions including shapes where one, some, or all of the side surfaces may have some curvature along their width (with the remaining surfaces being planar), and the adjacent surfaces may transition from each other (such as the top to the left side surface, by way of example) with a curved transition instead of an edge, with other transitions formed with edges. In some embodiments, the central portions 61/81, 161/181 of each of the tubes are arranged such that a first plane 3000 (FIG. 5) extends through each of the upper facing surfaces (projections) and a second plane 3001 that is parallel to the first plane extends through each of the downward facing surfaces (projections).

Figure 2:
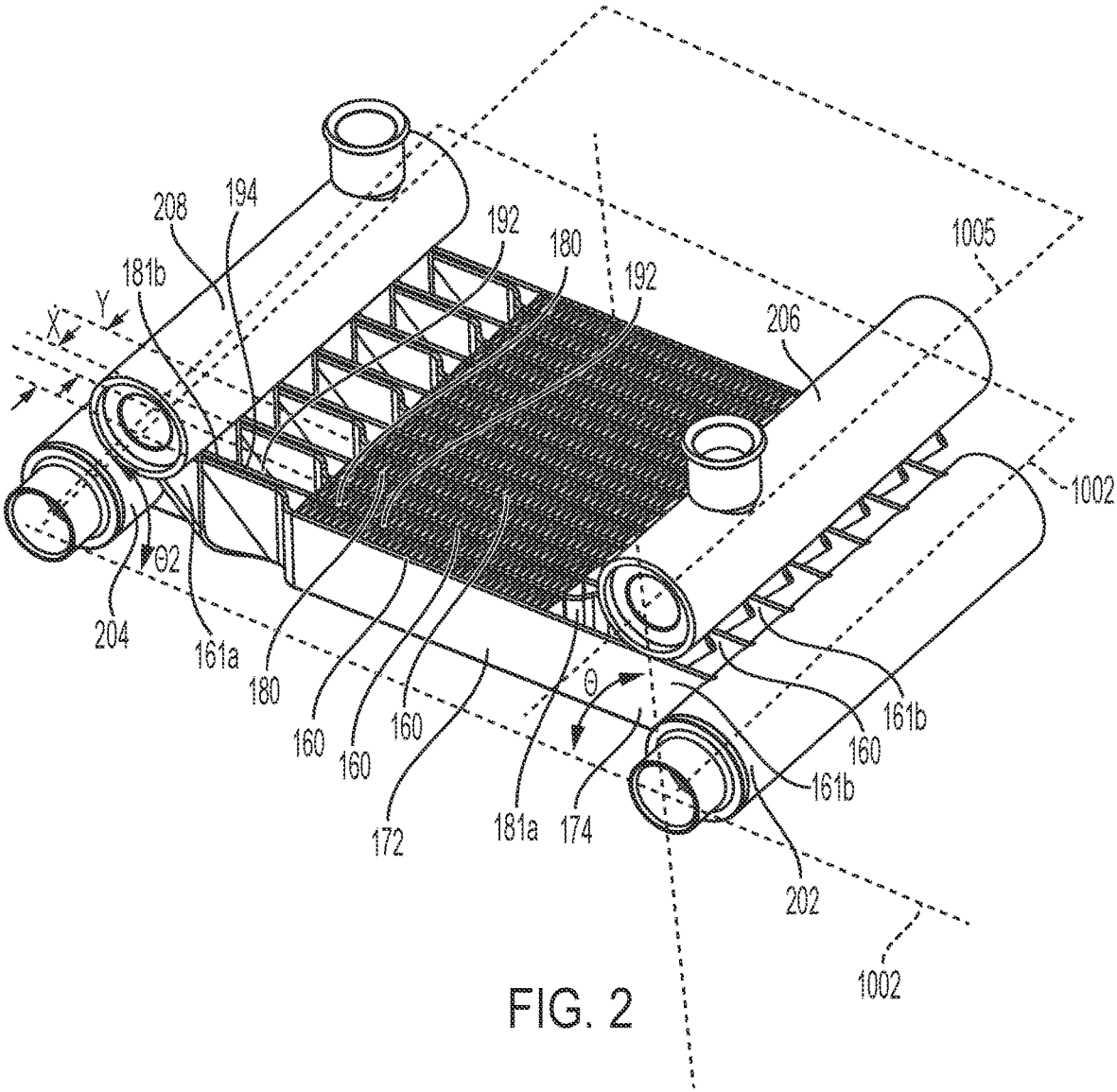
FIG. 2 is a partial perspective view of another heat exchange assembly for use in a heat pump system that can operate in a heating mode or a cooling mode, the heat exchange system would include a plurality of additional tubes along the space Z in the figure that are the same as the tubes 160, 180 depicted in the figure in an alternating fashion.

The first and second plurality of tubes 60/160 and 80/180 may connect to opposite manifolds that assist with distributing the flow of refrigerant such that the first manifold reached by the refrigerant approaches the respective set of tubes allows the flow to separate to flow in parallel through each of the tubes until reaching the opposite manifold, which returns the refrigerant to a single flow to flow out of the manifold to the next portion of the refrigerant circuit. As best shown in FIGS. 1 and 2, two manifolds (92, 93—FIG. 1; 202, 204, FIG. 2) are provided with centers that are in-line with a plane 1002 through the center portion (61/81—FIG. 1 161/181—FIG. 2) of each of the plurality of tubes (60/80—FIG. 1, 160/180—FIG. 2), and two other offset manifolds (94, 95—FIG. 1, 206, 208—FIG. 2) are disposed vertically above and in some embodiments horizontally offset from the two in-line manifolds. Specifically, the offset manifolds are positioned such that line 1108 that extends through a centerline 1102 of an inline manifold (e.g. 92, 202) and a centerline 1105 of the offset manifold (e.g. 94, 206) is perpendicular to, or at an acute angle to, the plane 1002 through the two inline manifolds (92/94, 202/204), such that at least a portion of the two offset manifolds rests above the plurality of tubes, as understood with respect to the figures.

In some variations of one or both of the first and second embodiments 50, 150, a plurality of fins 58 (or air centers) are provided that extend from the each of the first set of tubes 60/160 along a central portion 61/161 of each of the first set of tubes. In some variations, the plurality of fins 58 may extend to make contact with (and in some embodiments may be fixed to) the adjacent second set of tubes 80/180. In some other variations of the first and second embodiments 50/150, a plurality of fins 58 are provided that extend from each of the second set of tubes 80/180 along a central portion 81/181 of each of the second set of tubes. In some variations, the plurality of fins 58 may make contact with the first set of tubes 60/160. In some embodiments, the plurality of fins 58 may be fixed to both adjacent first and second tubes 60/160, 80/180 and may be manufactured as a separate component that is fixed to the adjacent tubes, such as by brazing. The fins 58 may be in various shapes that maximize the available surface area for heat transfer from or to the fins 58 (resulting in heat transferring from or to the refrigerant flowing through the tubes) due to outside ambient air passing past the fins, either with one or more fans urging air to flow therepast, or without forced air flow. For example, the fins 58 may be a series of parallel plates that each extend approximately perpendicular to a line through each central portion of the tubes, or in other embodiments, the fins may be a plurality of X shaped fins (when viewed from above or below the central portions) with the tips of the X's contacting adjacent fins, or slightly spaced from contacting adjacent fins. The fins 58 that are adapted to be positioned between two adjacent tubes may be mechanically fixed to each other for ease of assembly and brazing.

Turning now to the first embodiment of the second heat exchanger system 50, the first set of tubes 60 each extend from the first inline manifold 92 to the second inline manifold 94, with a line between a center of the first manifold 92 extending through a tube of the first set of tubes 60. Each tube of the first set of tubes is straight, with a consistent cross-section within a central portion 61 in some embodiments and in other embodiments with a consistent cross-section along the entire length each tube 60.

The second set of tubes 80 each include a central portion 81 that is straight, and bent portions 81*a*, 81*b* on each opposite ends. The bent portions 81*a*, 81*b* make fluid connection with the opposed third and fourth manifolds 96, 98 that are off set with respect to proximate to the respective first and second inline manifolds 92, 94. In some embodiments bent portions 81*a*, 81*b* extend from the central portion 81 to engage the opposed third and fourth manifolds 96, 98 by making a bend that transitions to an orientation where the bent portions 81*a*, 81*b* connect to the respective third and fourth manifolds 96, 98 from a direction that faces with a vector component V1 that extends perpendicularly from the plane 1002 through the combined central portions 61, 81 of the first and second tubes 60, 80. In some embodiments, the bent portions also extend with a vector component V2 that is parallel to the plane 1002. In some embodiments, the bent portions 81*a*, 81*b* connect to respective manifolds in a direction that is substantially perpendicular to the plane 1002 through the combined central portions 81, 81 of the first and second tubes 60, 80. The term substantially perpendicular is specifically defined herein to include an exact perpendicular angle, as well as angles that are 15 degrees on either side of perpendicular. The second set of tubes 80 are preferably formed with relatively gradual bends to limit the restriction to flow within the lumens 25 within the tubes that extend within the bend portions of the tubes 80.

Turning now to the second embodiment of the second heat exchanger system 150 depicted in FIGS. 2-5, the first set of tubes 160 each extend from the first manifold 202 to the opposite offset manifold 208, and the second set of tubes 180 extend from the first offset manifold 206 to the opposite in-line manifold 204. The first and second sets of tubes 160, 180 each have a central portion 161, 181 that is disposed as discussed above with respect to the central portions 61, 81 of the embodiment discussed above, and a bent portion 161*a*, 181*a* on a first end thereof which extends from the central portion 161, 181 to connect to the respective offset manifold. The opposite end of the tubes 160, 180 has an end 161*b*, 181*b* that extends from the central portion 172, 192 with the same geometry and orientation as the central portion 161, 181, which connects to the respective inline manifold 202, 204. As with the tubes 60, 80 discussed above, the bent portion 161*a*, 181*a* of the first and second sets of tubes 160, 180 are formed with relatively gradual bends to allow the orientation of that portion of the tube to change by limit the restriction to flow within the lumen that extends through the bent portion.

Figure 3:
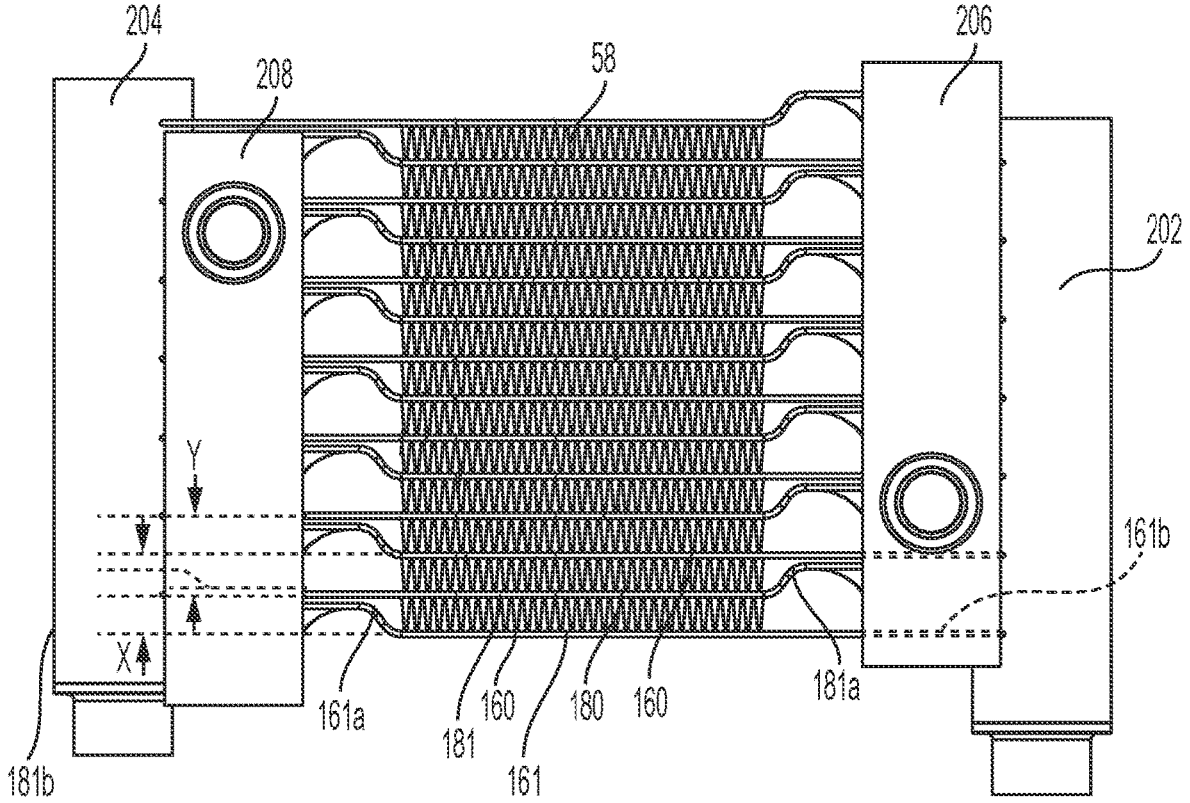
FIG. 3 is a partial top view of the heat exchange assembly of FIG. 2, the heat exchange would include a plurality of additional tubes along the space Z in the figure that are same as tubes 160, 180 depicted in the figure in an alternating fashion.
Figure 3A:
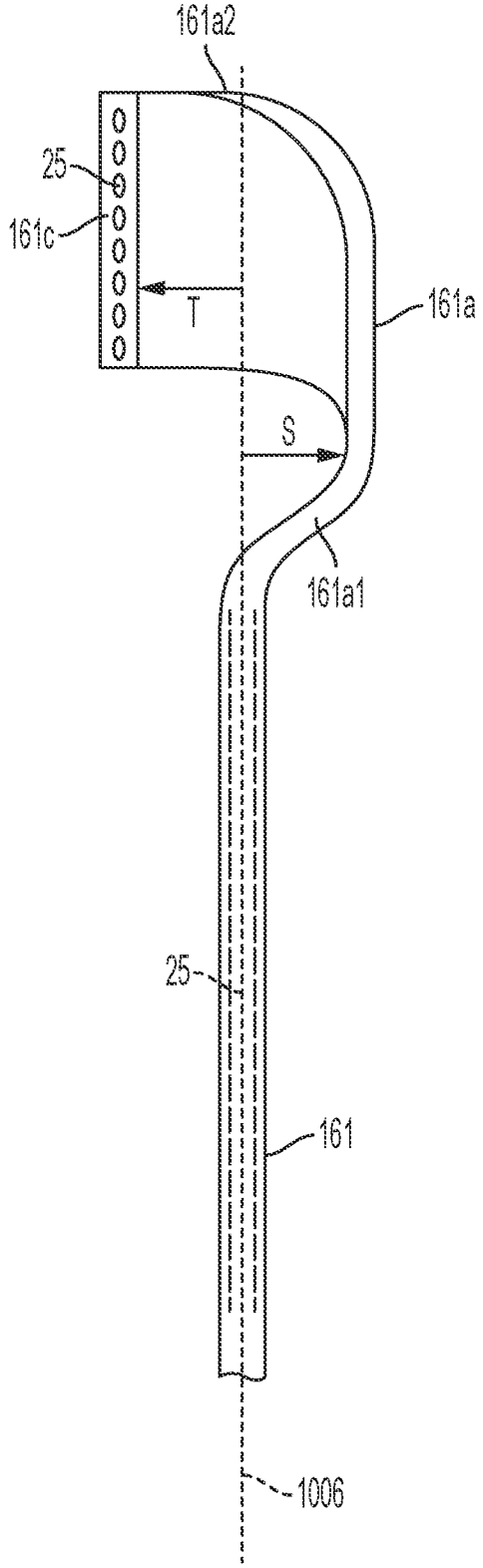
FIG. 3*a* is partial top view of a tube for use with the heat exchange assembly of FIG. 2 depicting the bent portion and a portion of the central portion.
Figure 4:
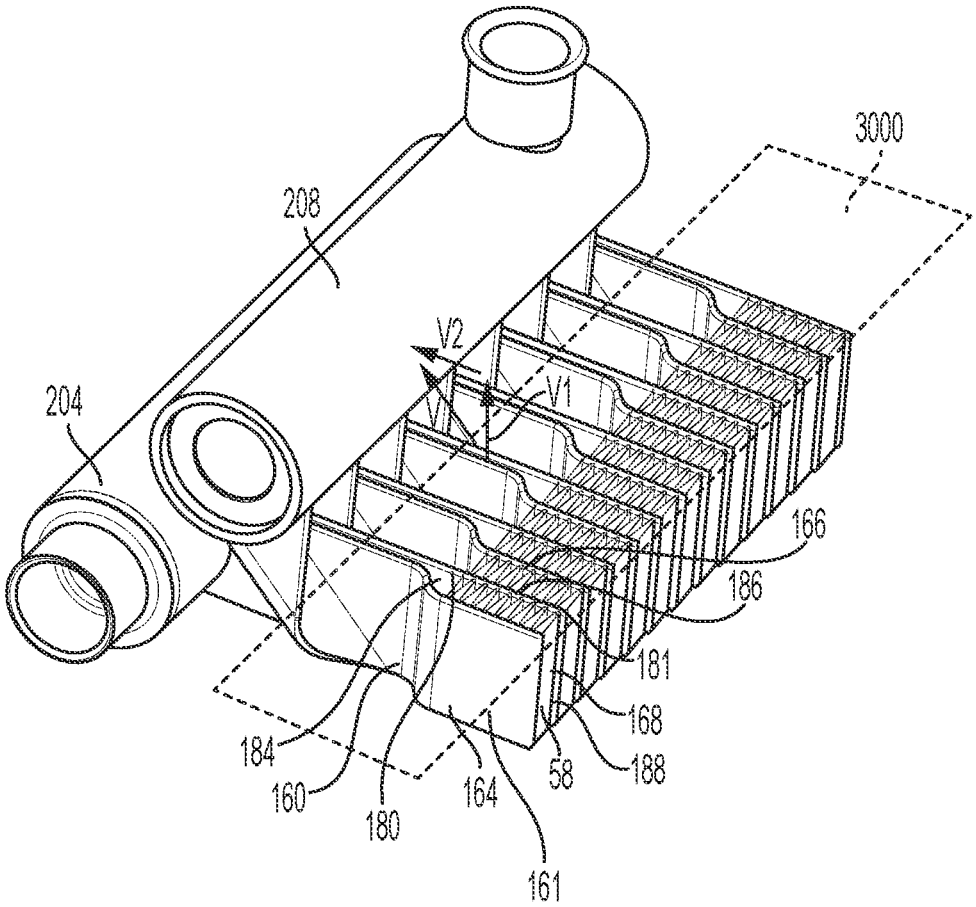
FIG. 4 is a perspective sectional view of the heat exchange assembly of FIG. 2, the heat exchange assembly would include a plurality of additional tubes along space Z in the figure that are same as tubes 160, 180 depicted in the figure in an alternating fashion.
Figure 5:
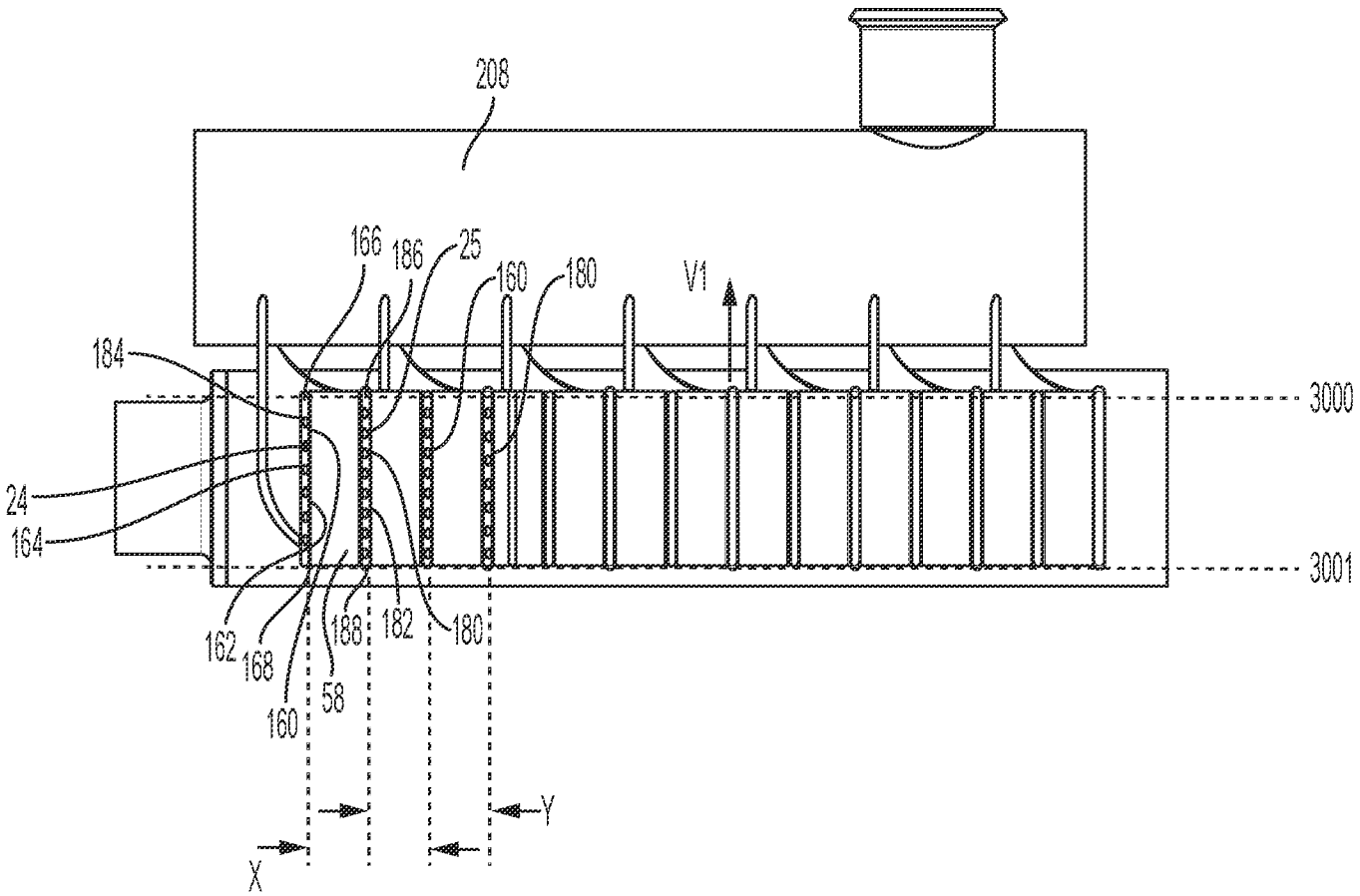
FIG. 5 is an end sectional view of the heat exchange assembly of FIG. 2, the heat exchange assembly would include a plurality of additional tubes along space Z in the figure that are the same as tubes 160, 180 depicted in the figure in an alternating fashion.

In some embodiments, the bent portion (which may be formed with bends, or curves or both features) 161*a*, 181*a* is oriented such that a portion the bent portion 161*a*, 181*a*, extends from the central portion 161, 181 and extends on both the right direction S and the left direction T from a line 1006 that extends through the central portion 161, 181 and is parallel the right and left side walls of each respective tube (e.g. walls 164, 162 for the first tubes and walls 184, 182 for the second tubes). Specifically as shown in FIG. 3*a* of a portion of a tube 160 (tubes 180 may be the same in some embodiments, or exactly the opposite in other directions) includes a bent portion 161*a*, that may initially include a first bend 161*a*1 that extends in the right direction so that the tube travels on the right side of the line 1006, and then a second bend 161*a*2 that extends in the left direction such that the tube extends on the left side of the line 1006. In some embodiments, the bent portion 161*a*, 181*a* may include a bend that extends about the same distance from the plane in the maximum right direction and in the maximum left direction. The term about the same distance is defined herein to mean the exact same distance as well as distances that are within a range of plus or minus 20% of the total distance of the reference distance inclusive of all values within the range. In some embodiments, the bend 161*a*1 may initially extend in the right direction (from the central portion 161*a*) and then extend in the left direction, while in other embodiments, the bend may initially extend in the left direction and then extend in the right direction.

In some embodiments, the tip 161*c* (tubes 180 may have the same feature) of the bent portion 161*a* (which connects to the respective offset manifold (206, 208) extends a maximum right or left distance from the line 1006 with the bent portion 161*a* previously extending a maximum opposite left or right distance before reaching the tip 161*c*. In some embodiments, the maximum right and left distances that the bent portion travels may be substantially the same distance. Substantially the same distance is defined herein to mean the exact same distance as well as a range of plus or minus 20% of the total distance of the reference distance, inclusive of all values within the range.

The bend 161*a*, 181*a* also transitions the tube 160, 180 such that it extends in a direction that the upper walls 166, 186 face to allow the tube to contact and flow into the offset manifold 206, 208, which is positioned above the upper wall 166, 186 of the tube 160, 180. In some embodiments, one or both of the right and left extending portions 161*a*1, 161*a*2 may also include extend upwardly. Alternatively, the right and left bending portions 161*a*1, 161*a*2 may be in series with the upward bending portion such that the upward bend occurs in a different section of the tube that bends in the left and right directions.

In other embodiments, the bend may include only a left bend or a right bend (as defined above) and may include, with one of the left or right bends, an upward bend. Those of skill in the art with a thorough review of this specification will understand that the terms "right, "left," "upward," and "downward" relate to those directions as they occur within a given coordinate system disposed with respect to heat exchange system 50, 150, and these directional terms do not limit the actual direction that the heat exchange system is disposed when in use or when being manufactured with respect to the typical directions upon the earth or with respect to the force of gravity. For example, the heat exchange system 50, 150 may be positioned in an orientation in use or when being assembled or manufactured, such that the surface of the tubes that is designated as the "upper" surface faces downward (directly or with a vector component toward the earth) or in a complete or partial sideward direction.

An exemplary embodiment of a tube that is usable as tubes 60/80 and 160/180 is described herein, and depicted in FIGS. 12*a*-15*b*.

Figure 12A:
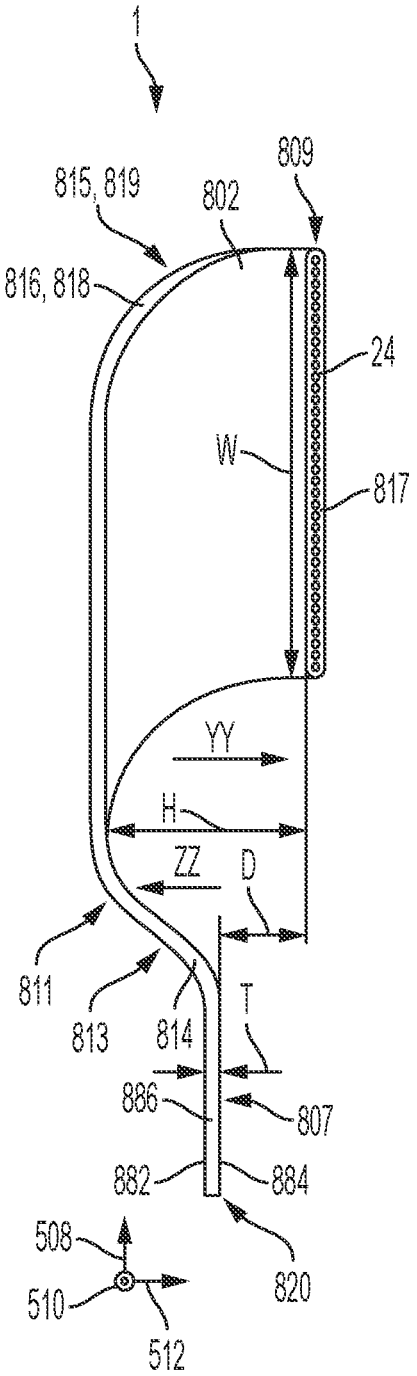
FIG. 12*a* is a top view (view in transverse direction) of curved portion and a portion of a straight portion of a tube that can be used within the heat exchangers of FIG. 1 or 2.
Figure 12B:
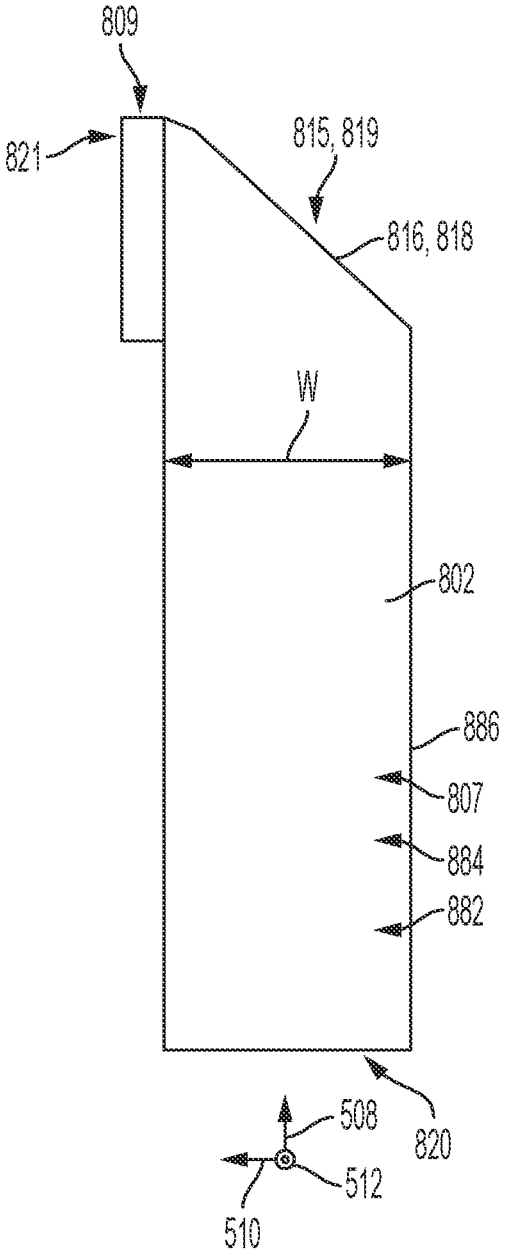
FIG. 12*b* is a side view (offset view) of the tube of FIG. 12*a*.

FIG. 12A shows an example of a tube 800 that is usable as tubes 160/180 according to the invention in a view along a transverse direction 510 (top view). The tube 800 can be modified to include bent portion 811 on both ends of the tube to allow the tube to be used as tube 80 in the embodiment of FIG. 1 described above. FIG. 12B shows the example of FIG. 12A in a view along an offset direction 512. As to be seen from FIGS. 12A and 12B, the tube 800 has a tube body 802, which delimits at least one coolant channel 24 through which a coolant or a refrigerant can flow. In the example of FIG. 12A, the tube body 802 delimits numerous coolant channels 24, which are arranged in a queue along the width W of the tube 800. A division wall 817 extending along the thickness T of the tube body 802 is present between two directly adjacent coolant channels 24. For example, tube body 802 has a uniform material or consists of such a uniform material. The material of the tube body 802 for instance is a metal.

Figure 13A:
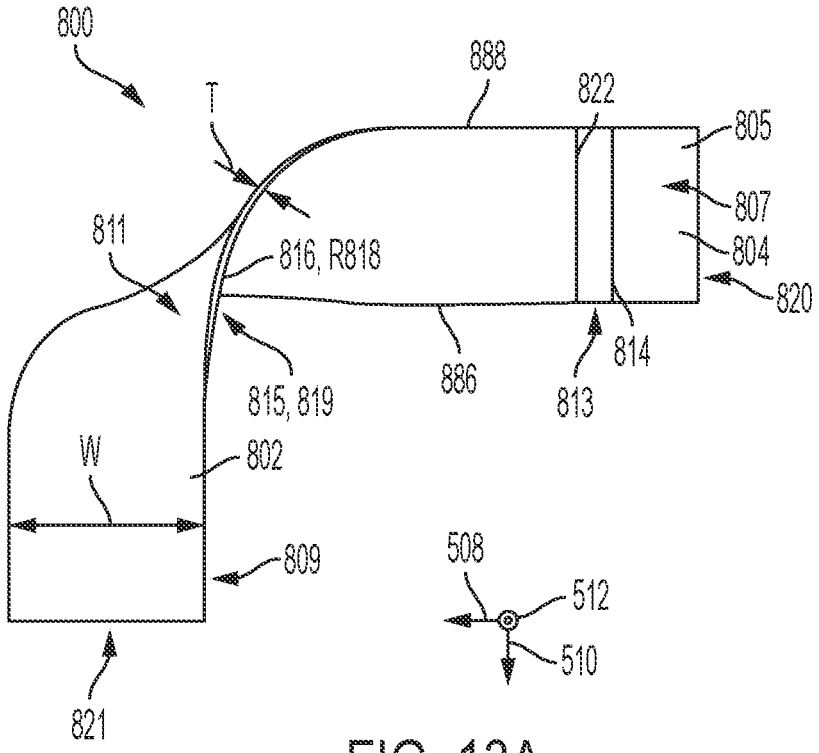
FIG. 13*a* side view of a curved portion and a portion of a straight portion of another tube that can be used with the heat exchangers of FIG. 1 or 2.
Figure 13B:
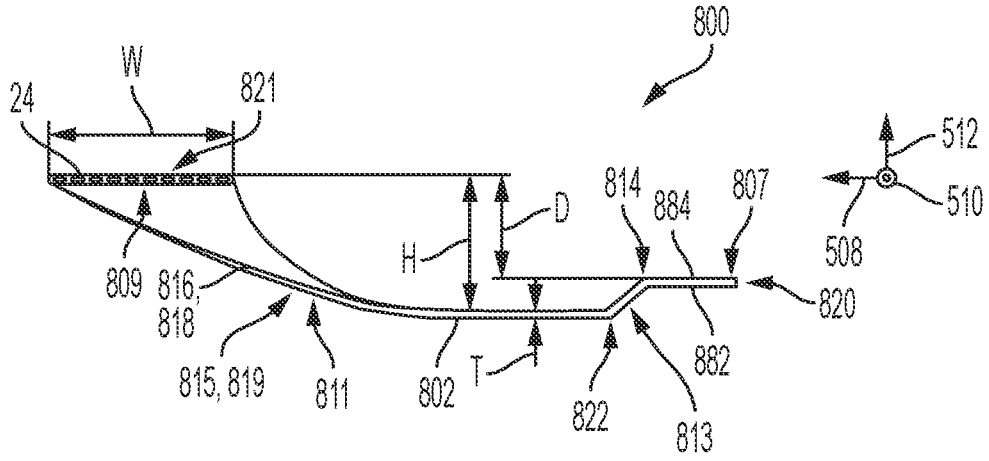
FIG. 13*b* is a top view of the tube of FIG. 13*a*.
Figure 14B:
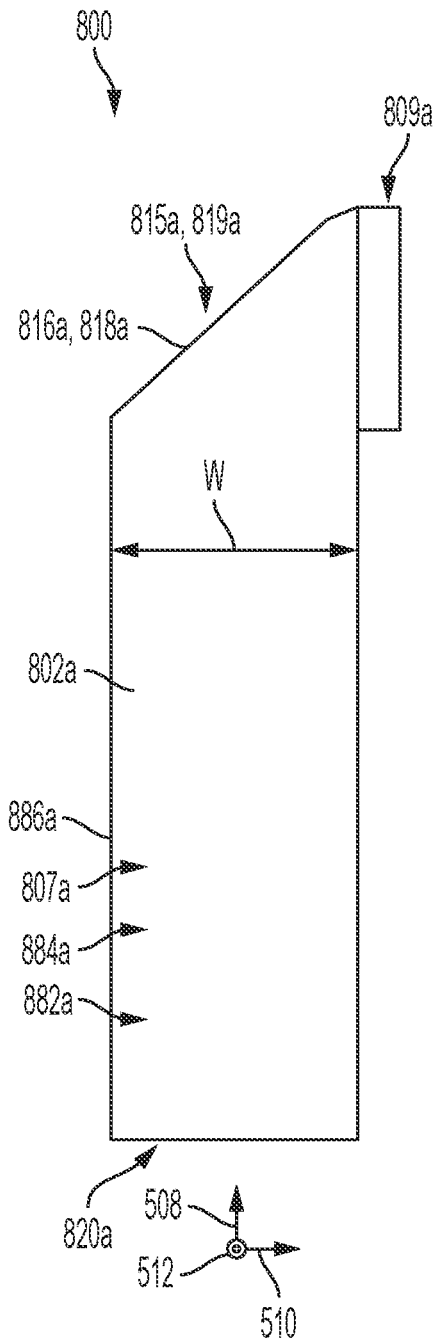
FIG. 14*b* is a side view of the tube of FIG. 14*a*.
Figure 14A:
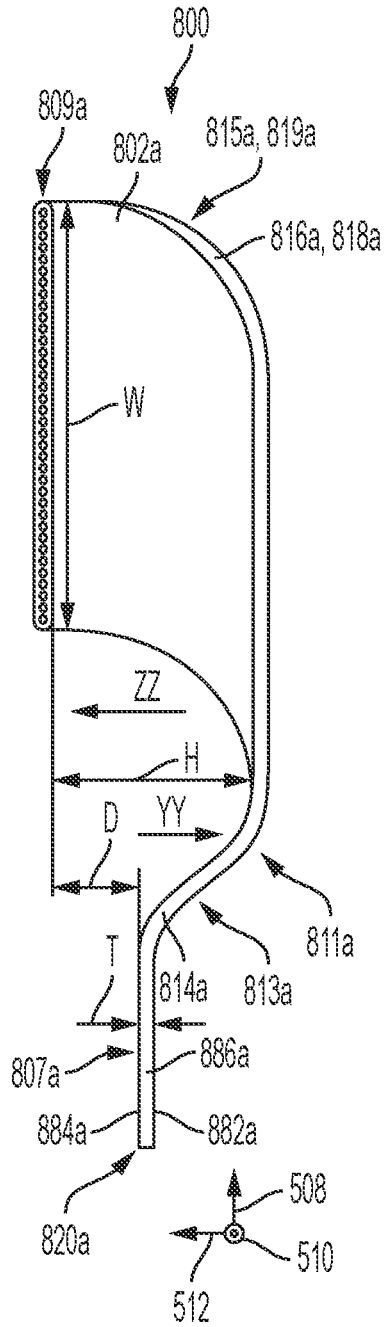
FIG. 14*a* is top view of a curved portion and a portion of a straight portion of another tube that can be used with the heat exchangers of FIG. 1 or 2, potentially with a heat exchanger constructed with a plurality of tubes line the tube in FIG. 14*a* aligned in an alternating manner with a plurality of tubes like the tube in FIG. 12*a*, with the curved portions of the alternating tubes disposed at opposite ends of the heat exchanger.
Figure 15A:
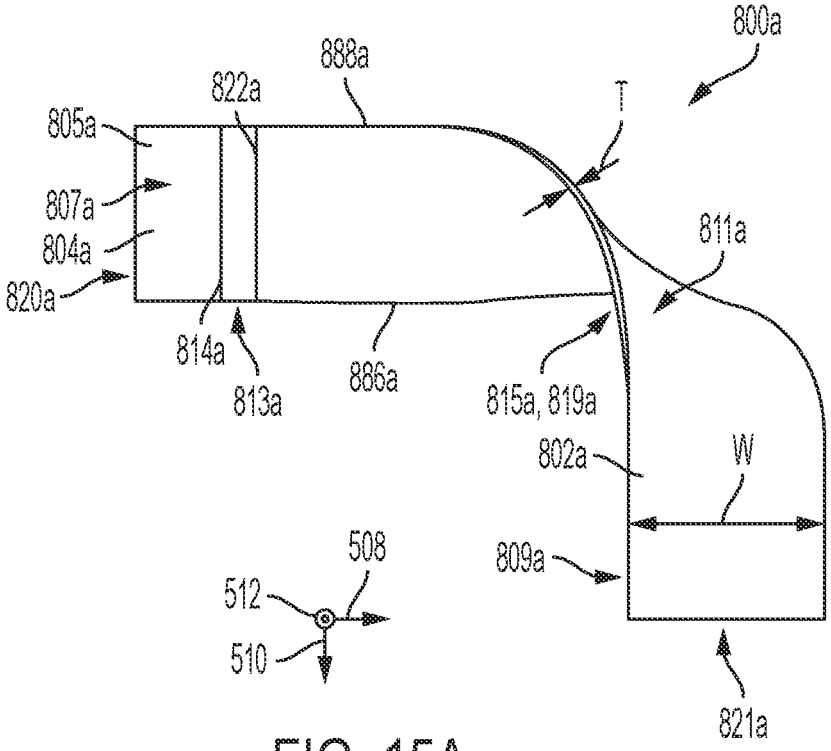
FIG. 15*a* is a side view of a curved portion and a portion of a straight portion of another tube that can be used with the heat exchangers of FIG. 1 or FIG. 2, potentially with a heat exchanger constructed with a plurality of tubes line the tube in FIG. 15*a* aligned in an alternating manner with a plurality of tubes like the tube in FIG. 13*a*, with the curved portions of the alternating tubes disposed at opposite ends of the heat exchanger.
Figure 15B:
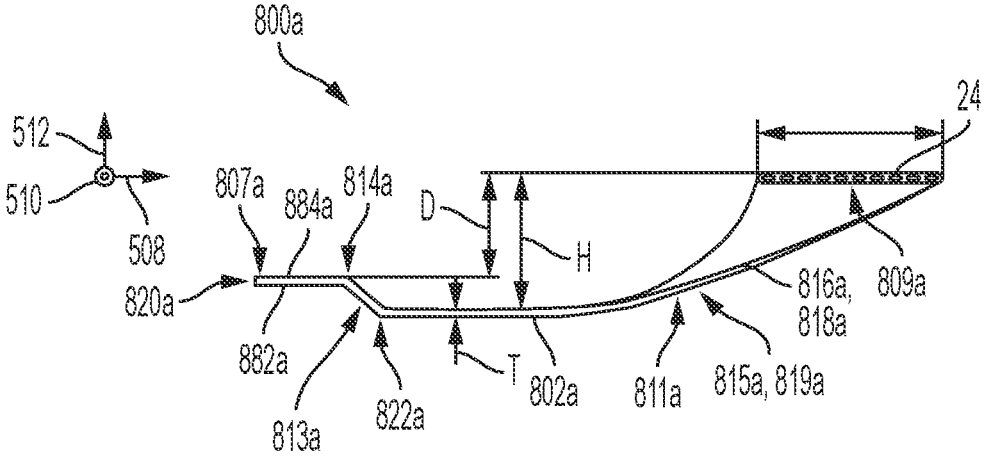
FIG. 15*b* is a top view of the tube of FIG. 15*a*.

FIG. 13A illustrates another example of the flat tube 800 according to the invention in a view along the offset direction 512 (left side view). FIG. 13B shows the example of FIG. 13A in a view against the transverse direction 510 (top view). In other words, the perspective of FIG. 13A corresponds to that of FIG. 12B, whereas the perspective of FIG. 13B is similar to that of FIG. 12A.

As to be seen from FIGS. 12A, 12B, 13A and 13B, the tube body 802 has an outer first side surface 882 and an outer second side surface 884, which are arranged opposite one another at a thickness T of the tube body 802. Tube body 802 also has opposite top 886 and bottom surfaces 888, which are arranged opposite one another at a width W of the tube body 802. The top and bottom surfaces connected the side surfaces 882, 884. Tube body 802 has a central portion 807, which serves as the main heat exchange portion (and corresponds to the central portions 61/81 161/181 of the embodiments discussed above), which substantially extends along an extension direction 508. Tube body 802 has an angled portion 809, which substantially extends along a transverse direction 510 that is inclined with respect to the extension direction 508. Tube body 802 has a bent portion 811, which connects the heat exchange portion 807 to the angled portion 809. The combination of the bent portion 811 and the angled portion 809 corresponds to the bent portion in the embodiments discussed above.

It is to be seen from FIGS. 12A and 13B, that the angled portion 809 is arranged at a distance D from the heat exchange portion 807, which distance D is to be measured in the offset direction 12. The offset direction 12 is substantially perpendicular to both the extension and the transverse direction 508, 510. The bent portion 811 has a first bend 814, which is present in a first end region 813 of the bent portion 811 that faces the heat exchange portion 807. As depicted in the embodiments of FIGS. 12 and 13, the first end region may travel away from the heat exchange portion generally in the direction ZZ. The first bend 814 of the bent portion 811 is bent counter to the offset direction 512. Furthermore, the bent portion 811 has a second bend 816, which is present in a second end region 815 that faces the angled portion 809. The second bend 816 is bent in the offset direction 512 (YY). In other words, in the first end region 813 the tube body 802 is set back opposite the heat exchange portion 807 counter to the offset direction 512 due to the first bend 814. Accordingly, in the second end region 815 the tube body 802 is protruding from the heat exchange portion 807 and from the first end region 813 in the offset direction 512 due to the second bend 816. The bent portion 811, for example, has an S- or Z-like geometry 19, which denotes that the bent portion has several bends that extend in different directions with respect to the offset direction (512), i.e. the bent portion includes bends with vector components that extend in the ZZ direction and in the YY direction (FIG. 12*a*). Between the first bend 814 and the second bend 816 a step bend 822 (see FIGS. 13A and 13B) can be present. The first bend 814 can have an S- or Z-like shape consisting of two sub-bends, one of which is directed against and one of which is directed in the offset direction, wherein both sub bends together cause the tube body 802 to withdraw counter to the offset direction 512 (direction ZZ) whilst distancing from the heat exchange portion 807 in the extension direction 808. When the first bend 814 comprises of two sub-bends, which both together have the S- or Z-like shape, the second bend 816 may steadily add to the S- or Z-like geometry as to form the S- or Z-like geometry 819 of the bent portion 811.

Additionally, FIGS. 12A, 12B, 13A and 13B show that the extension direction 808 substantially follows a straight line. The transverse direction 510 in the examples of FIGS. 12A, 12B, 13A and 13B is substantially perpendicular to the extension direction 808. It goes without saying that as an alternative the transverse direction 510 in contrast to the right angle of FIGS. 12A, 12B, 13A and 13B may be inclined by a different angle opposite the extension direction 808. The transverse direction 10 can follow a straight or a curved line. The distance D at which the angled portion 809 is arranged opposite the heat exchange portion 807 is smaller than a minimum bending radius R of the second bend 816. The minimum bending radius R of the second bend 816 for example is 3 to 6 times the tube thickness T of the tube body 802. The minimum bending radius R can be 0.70 to 0.95 times the tube width W. These minimum bending radii have been determined to prevent restriction of the various flow lumens 24 through the tube, which can occur with tighter bend radii, due to the localized expansion and contraction at opposite sides of the walls forming the flow lumen during bending. The minimum bending Radius R can be determined by an inner height H of the bent portion 811, which is measured along the offset direction 512. When progressively distancing from the heat exchange portion 807, the bent portion 811 firstly is set back counter to the offset direction 512 by the first bend 814, then the bent portion 811 by its second bend 816 begins rising in the offset direction 512 as to cross a plane containing the heat exchange portion 807 and lastly transfer into the angled portion 809 in the offset direction 510.

According to FIGS. 12A, 12B, 13A and 13B, the second bend 816 is a twist-bend 818. The second bend 818 extends generally in the YY direction as well as the direction 510 (out of the page when reviewing FIGS. 12A and 13B). This means that in the second bend 816 the tube body 802 is bent and twisted at the same time, such that on the one hand the distance D between the angled portion 809 and the heat exchange portion 807 is bridged and on the other hand the exact same surface area of the tube body 802, which in the heat exchange portion 807 represents the top surface 884, mutates to the bottom surface 882 in the area of angled portion 809. Thus, the tube body 802 can be twisted 180 degrees in the second bend 816.

In other embodiments depicted in FIGS. 14A-15B, an alternate tube 800*a* may be formed with the exact opposite construction with respect to the bending portions that extend with vector components in the directions ZZ and YY may be formed. The tube 800*a* includes all of the features of tube 800 discussed above, but the first end region travels away from the heat exchange portion generally in the direction YY (i.e. in the offset direction 512), and the second bend extends generally in the ZZ direction (counter to the offset direction 512) as well as the direction 510 (out of the page when reviewing FIGS. 14*a* and 15*b*). Other than the portions that extend with vector components in the ZZ and YY directions, the structure of the alternate tube 800*a* is the same as tube 800, and the features depicted in FIGS. 14A-15B designated as "element number+a" (e.g. 800*a* corresponding with element 800 of embodiment of FIGS. 12*a*-13*b*, 802*a* corresponding with element 802, etc.) corresponding to the structure designated with the same element number (without the "a" in FIGS. 12*a*-13*b*). The alternate tube 800*a* may be used in the same heat exchange system 150 as the tube 800, with a plurality of tubes 800 (for example) being used as the first set of tubes 160 and a plurality of tube 800*a* being used as the second set of tubes 180. In embodiments where the system 50 is constructed, the tubes with bent portions may be formed with opposite ends such that one end of the tube is formed with the non-straight portion as in tube 800 (e.g. to connect to manifold 96) and the opposite end is formed with the non-straight portion as in tube 800*a* (e.g. to connect to manifold 98) Alternatively, the tubes with bent portions may be formed with both ends as the bent portion of tube 800, or with both ends as the bent portion of tube 800*a*—either way to connect to opposite manifolds 96, 98.

As discussed above, the second heat exchanger assembly 50/150 is provided within a closed heat exchange system 10, which includes the second heat exchanger system 50/150 that is disposed in an outdoor environment and a first heat exchanger 300 that is disposed within an indoor environment. These two heat exchangers, in combination with a compressor 32 and an expansion valve 38 form a closed heat pump circuit. The typical operation of conventional heat pump circuits are well understood. The heat exchange system 10 can be operated with refrigerant flow in a first direction, as depicted in FIG. 6, to result in the first heat exchanger 300 receiving heat to allow for increasing the temperature of a space where the first heat exchanger is located or to provide heat to a fluid that flows with respect to the first heat exchanger. The heat pump circuit of the system 10, may cause the refrigerant to flow in the opposite direction, as depicted in FIG. 7, to result in the first heat exchanger 300 adding heat to the refrigerant that flows therethrough to result in the first heat exchanger 300 cooling the space where it is located or cooling a fluid that flows therepast. The system 10 is aligned such that during a cycle of refrigerant flow through the system, refrigerant flows through both sets of tubes 60/80, 160/180 within the second heat exchanger assembly 50/150 before flowing into through the first heat exchanger 300 (or depending upon where the "start" of the flow is considered within a single refrigerant flow circuit, refrigerant leaving the first heat exchanger 300 flows through both the first and second sets of tubes 60/80 160/180 before returning to the first heat exchanger 300.

With reference to FIG. 6 depicting the flow of refrigerant when the circuit is in heating mode, the flow of refrigerant is as follows: refrigerant leaves the first heat exchanger 300 (indoor heat exchanger, operating as a condenser) via a first fluid connection 304 and travels through piping to an outdoor environment 14. The refrigerant first encounter parallel piping with an expansion valve 38 and a check valve 39, which is aligned such that flow does not flow through the expansion valve 38 but refrigerant does flow through the check valve 39 (i.e. the check valve 39 is piped to allow flow from right to left (from the perspective of the schematic of FIG. 6). Refrigerant next flows to the second heat exchanger system 50/150 (operating as an evaporator) and encounters one of the two sets of tubes (60/80 160/180). (FIG. 6 is drawn such that refrigerant first encounters the tubes 80, 180 and the flow will be described in this manner but one of ordinary skill in the art will readily comprehend that the second heat exchanger system 50/150 can be flipped such that the refrigerant first flows through the tubes 60, 160). Upon leaving tubes 80, 180 the refrigerant flow reaches parallel piping with another expansion valve 138, and a check valve 139. The check valve 139 is piped to prevent flow therethrough when being approached from the left (from the perspective of the schematic of FIG. 6) such that refrigerant flows through the expansion valve 138 and is expanded. Refrigerant then flows through the other set of tubes 60, 160 and then to the 4 way valve 42. The four way valve 42 ports the refrigerant flow to the inlet of the compressor 32, which compresses the refrigerant. Refrigerant fluid leaving the compressor 32 flows again though the four way valve 42, which is then directed toward the first heat exchanger 300, and fluid enters the first heat exchanger 300 within the indoor space 12 via the second fluid connection 302. The refrigerant (during system operation) continuously operates in this manner thereby continuously providing the first heat exchanger 300 with relatively warm refrigerant such that the heat can be used in the indoor space as desired. Accordingly, when in the heating mode, refrigerant flows through one of the sets of tubes 80, 180 and then flows through the expansion valve 138 and then flows through the other set of tubes 60, 160 before flowing to other components within the system. In the heating mode, the first set of tubes 80, 180 encountered by the refrigerant acts as a condenser during the first pass through the heat exchanger where it performs the sub-cooling function in the outside heat exchanger, instead of the sub-cooling function being performed in an indoor space as with conventional heat pump systems in the heating mode. The subcooling within the outdoor space occurs before refrigerant flows to the expansion valve 138. After flowing through the expansion valve 138, the refrigerant flows through the other set of tubes 60, 160, which function as an evaporator. The heat transfer between (pre-expanded) refrigerant flowing through the tubes 80, 180 with the post-expanded refrigerant flowing through the tubes 60, 160 results in increased condenser inlet pressure and increased super heat of refrigerant that enters the inside heat exchanger 300 via port 302, which results in additional warming of the internal space/liquid during the heating mode. This also has the benefit of slowing down ice buildup on the outside second heat exchanger system 50/150 during operation during a cold outside air environment—thereby reducing the frequency that the system needs to operate to defrost the outside heat exchanger system 50/150.

With reference to FIG. 7 depicting the flow of refrigerant when the circuit is in cooling mode, the refrigerant flows in the opposite direction through the piping and the components as the heaving mode, discussed above. The flow of refrigerant when in the cooling mode is as follows: refrigerant leaves the first heat exchanger 300 (operating as an evaporator) through the second fluid connection 302 and flows to the four way valve 42. The four way valve 42 is ported in the cooling mode to cause the refrigerant to flow through the compressor 32, and then the compressed refrigerant flows again through the four way valve 42 and is ported to one of the sets of tubes of the second heat exchange system 50/150 (operating as a condenser), and specifically tubes 60, 160. Fluid leaving the tubes 60/160 reaches the parallel piping with the check valve 139 and the expansion valve 138. As discussed above, the check valve 139 is aligned to allow flow that approaches from the left (from the perspective of schematic FIG. 7) and therefore refrigerant flows through the check valve 139 and then to the other set of tubes 80, 180. Fluid leaving the second set of tubes 80, 180 flows to the other parallel pipes that include the check valve 39 and the expansion valve 38. The check valve 39 is aligned to prevent flow therethrough when approached from the left (from the perspective of schematic FIG. 7) and refrigerant flows through the expansion valve 38 thereby cooling the refrigerant due to the expansion. This cooled refrigerant flows into the indoor space 12 and into the first heat exchanger 300 via the fluid connection 304. The refrigerant (during system operation) continuously operates in this manner thereby continuously providing the first heat exchanger 300 with relatively cool gaseous refrigerant that is configured to remove heat from the indoor space. Accordingly, when in the cooling mode, refrigerant flows through one of the sets of tubes 60, 160 and then flows through the other set of tubes 80, 180 before flowing to other components within the system. In the cooling mode the indoor heat exchanger 300 acts as the evaporator and the second heat exchange system 50/150 acts as the condenser. In the cooling mode, the refrigerant flows from the compressor 32 and then to the tubes 60, 160. Refrigerant leaving the tubes 60, 160 flows through the check valve 139 (and not through the expansion valve) and then flows directly through the tubes 80, 180 to further super-heat the refrigerant flowing therethrough.

Figure 7A:
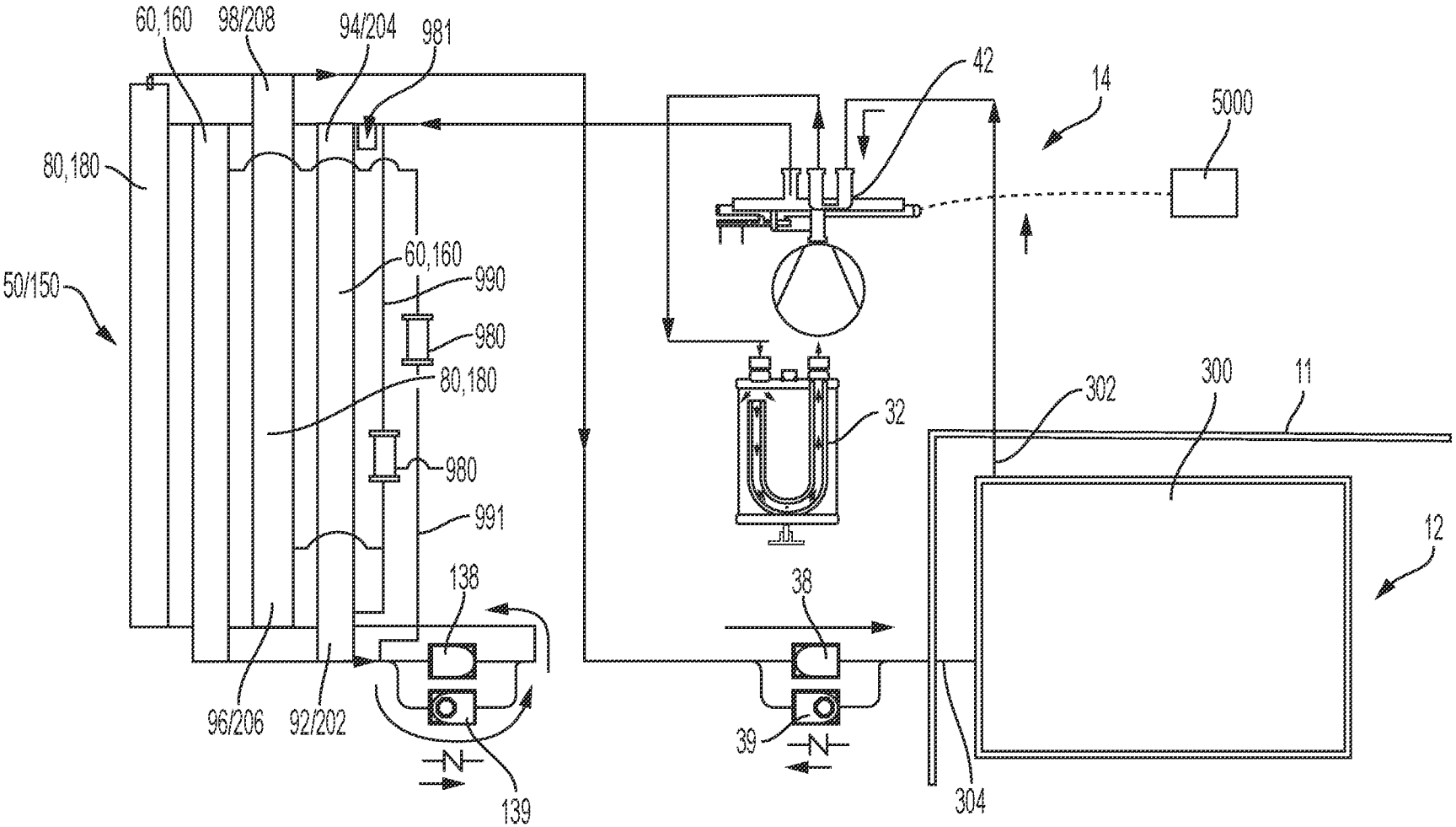
FIG. 7*a* is a schematic of FIG. 7 that includes alternate flow paths and isolation valves that can be implemented to allow the flow through the heat pump system to be parallel flow through all the first and second sets of tubes, or can be operated in the opposite valve positions to have reverse flow between the first and second sets of tube.

In a preferred embodiment, the manifolds of the heat exchange system are arranged such that the flow through the first set of tubes 60/160 and the second set of tubes 80/180 is in parallel to each other when in the cooling mode. In this embodiment, the flow when in the heating mode would also be in parallel to each other. In a preferred embodiment depicted in FIG. 7*a*, the piping in the system may include a set of isolation valves 980, 981 (which may be remotely operable valves operable by the controller or may be manual valves) and a second set of pipes 990, 991 that allow the direction of flow through one of the first or second sets of tubes to be changed, in order to allow for flow through the first and second sets of tubes 60/160 and 80/180 to be in the reverse directions across the heat exchanger when in the heating mode, but also operable to different positions to allow the flow to be in parallel in the same direction in the first and second sets of tubes when in the cooling mode—which greatly increases the efficiency of the system wherein the outside heat exchange system 50/150 acts as an evaporator.

Accordingly, the system 10 is disposed such that the operation between heating mode and cooling mode is established due to the operation of the four way valve 42. In the cooling mode, refrigerant leaving the inner heat exchanger 300 (via port 302) first reaches the first tubes 60/160 (and specifically the second manifolds 94/204) and leaves the first tubes via the first manifolds 92/202. Flow then flows through check valve 139 (bypassing expansion valve 139) and flows into the second tubes 80/180 via the third manifold 96/206, and leaves the second tubes 80/180 via the fourth manifolds 98/206. Alternatively, the heating mode, the four way valve 42 is realigned, causing refrigerant flow in the opposite direction. Flow leaving the inner heat exchanger 300 (via port 304) first reaches the second tubes 80/180 via the fourth manifold 98/208 and leaves the second tubes 80/180 via the third manifold 96/206. Refrigerant then flows through the expansion valve 138 and then enters the first tubes 60/160 via the first manifolds 92/202, and leaves the first tubes via the second manifolds 94/204. Refrigerant then flows to the four way valve 42, where it then flows through the compressor 32, and then returns to the four way valve 42 where the flow is ported to return to the inner heat exchanger 300 via port 302. In other embodiments, the flow may be controlled by multiple isolation valves that may be piped to cause flow through the various components of the system, in the order specified above, without the use of a 4 way valve. In some embodiments, the 4 way valve (or multiple valves that collectively direct flow as directed by the four way valve, may be automated valves that are positioned properly for the desired mode of operation by a controller 5000, while in other embodiments, the valves may be manual valves that are appropriately positioned by a user to establish the desired flow paths. In embodiments where a controller 5000 is provided, the controller 5000 may operate the compressor 32 and the expansion valves 38/138 as desired for appropriate thermal output of the inner heat exchanger 300, in view of the known or expected heat load, the ambient temperature surrounding the second heat exchange assembly 50, 150 as well as other factors.

Figure 8:
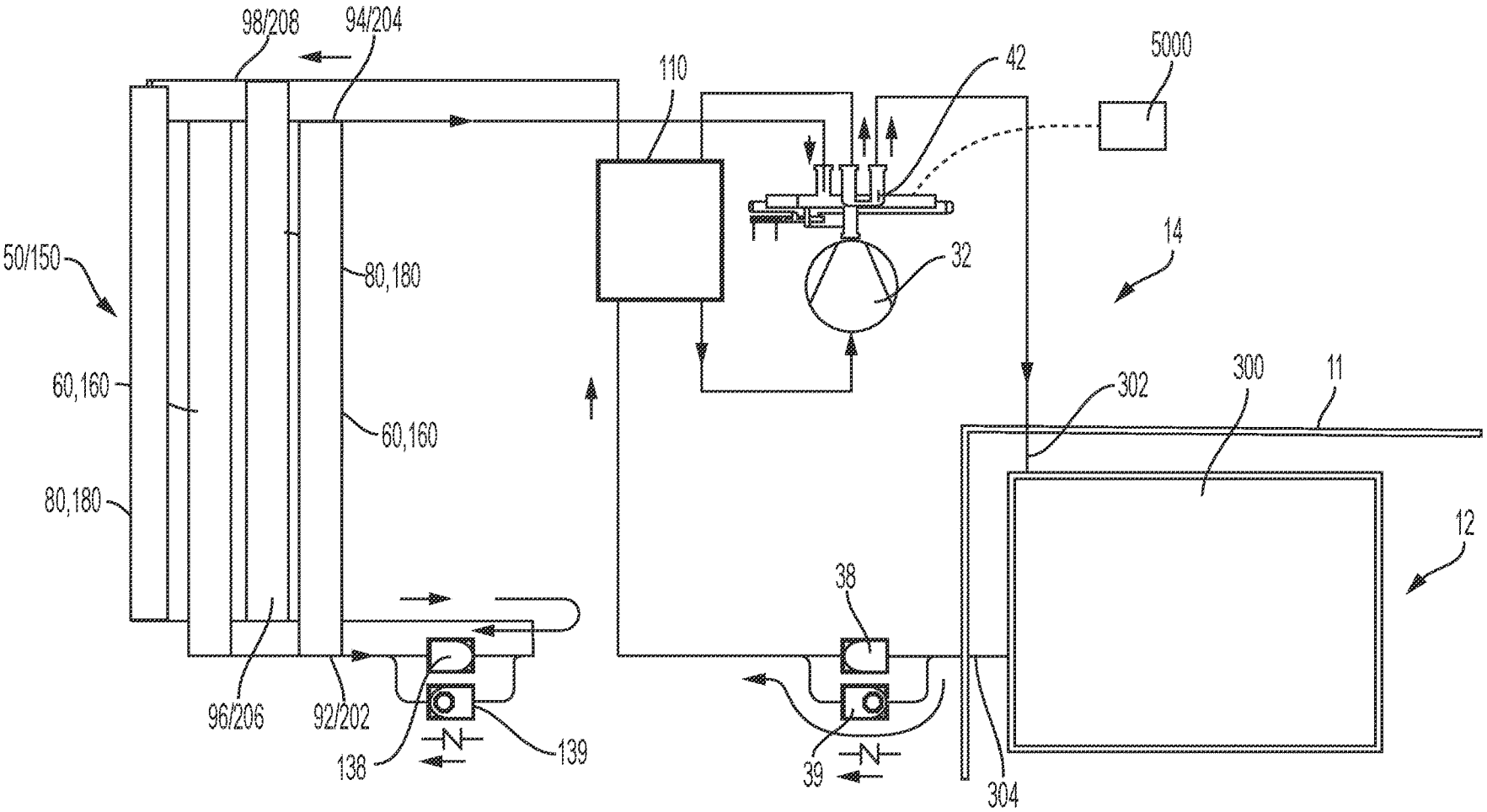
FIG. 8 is a schematic diagram of another heat pump system using the heat pump assembly of either FIG. 1 or FIG. 2 in a heating mode, and further including an intermediate heat exchanger.
Figure 9:
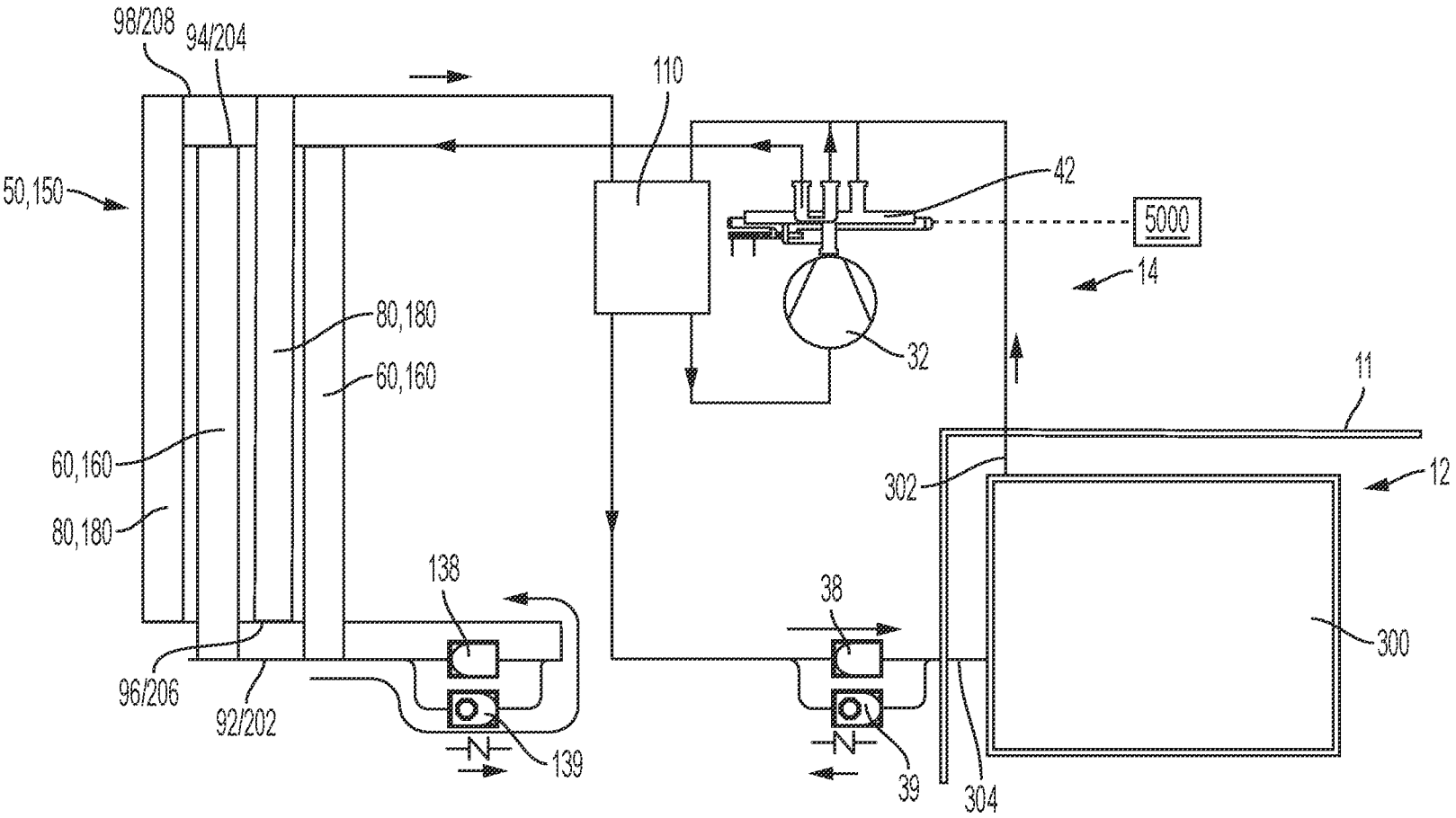
FIG. 9 is a schematic diagram of the heat pump system of FIG. 9 in the cooling mode.

FIGS. 8 and 9 depict an alternate system with an intermediate heat exchanger 110 (depicting flow in the heating and cooling modes, respectively) that includes an intermediate heat exchanger 110 that is positioned to assist, predominately, with the cooling mode (FIG. 9) where some heat is added to the refrigerant before it is compressed via the compressor 32, which minimizes the superheat of the refrigerant before it is compressed, and therefore minimizes the subcooling as the refrigerant flows to the first set of tubes. The heat for the intermediate heat exchanger would be provided by removing some heat from the refrigerant before it is expanded by the expansion valve 38 before flowing into the interior heat exchanger 300 via inlet 304. The inclusion of the intermediate heat exchanger 110 in the heating mode (FIG. 8) is not a preferred design.

Figure 10:
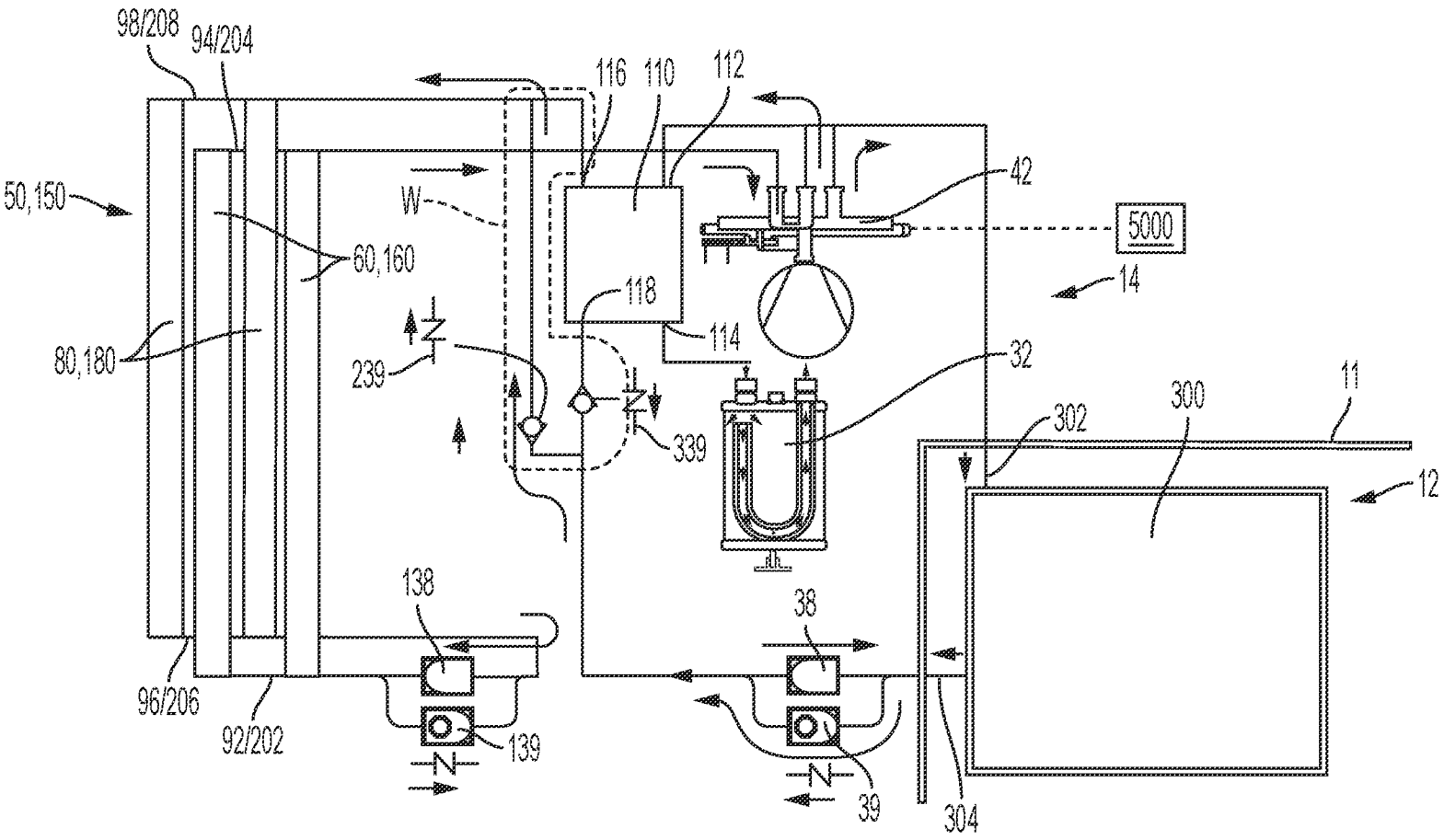
FIG. 10 is a schematic diagram of another heat pump system using the heat pump assembly of either FIG. 1 or FIG. 2 in a heating mode, further including an intermediate heat exchanger that is bypassed in the heating mode.
Figure 11:
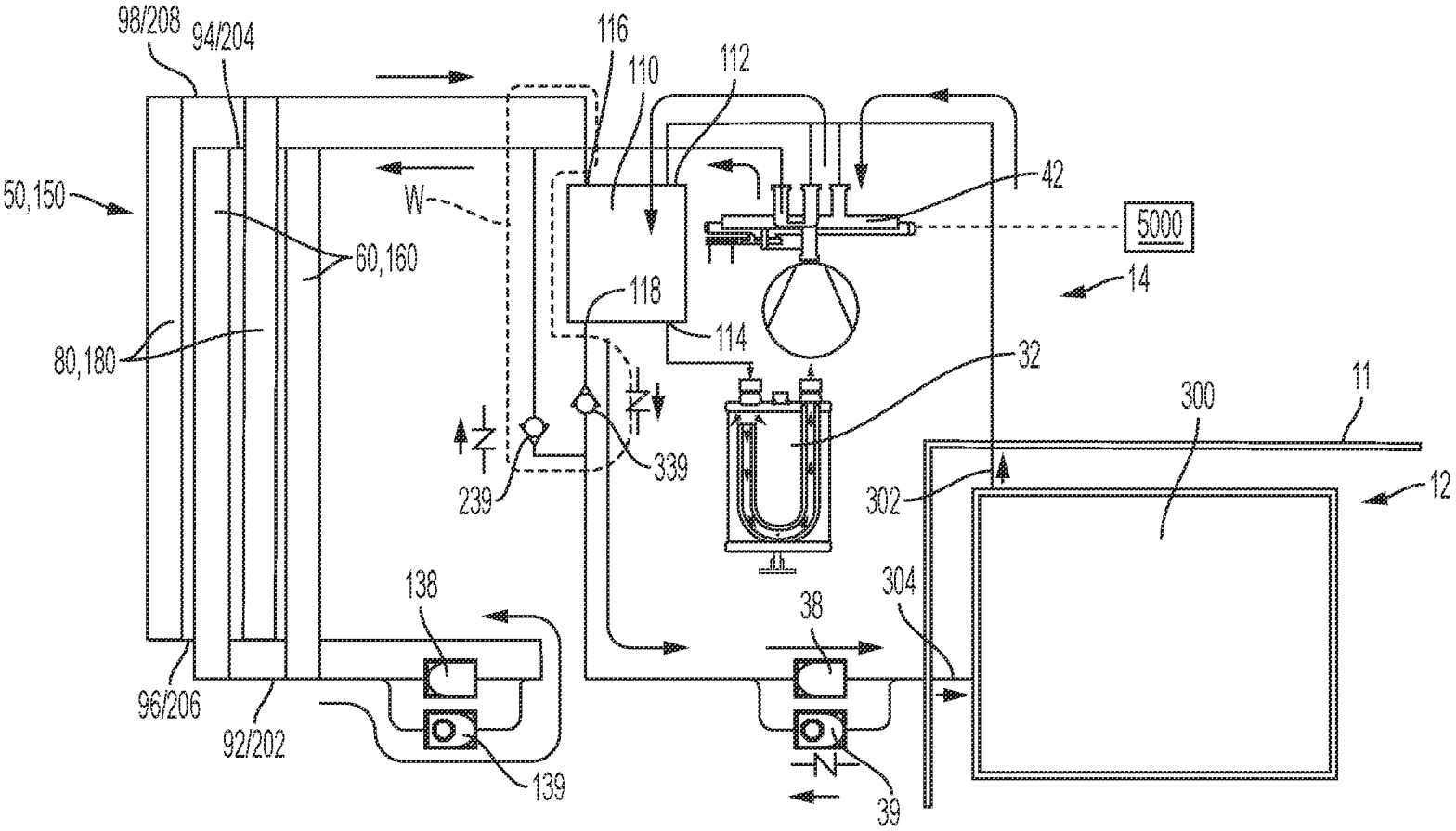
FIG. 11 is a schematic diagram of the heat pump system of FIG. 10 with flow through the intermediate heat exchanger in the cooling mode.

FIGS. 10 and 11 are improved designs with an intermediate heat exchanger 110, by introducing a refrigerant path W that allows refrigerant flowing from the first heat exchanger 300 via port 304 to bypass the intermediate heat exchanger when in the heating mode (FIG. 10) but allowing refrigerant leaving the heat exchange assembly 50/150 to flow through the intermediate heat exchanger 110 in the cooling mode, to achieve the benefits discussed above with respect to the intermediate heat exchanger 110 in the cooling mode. In this embodiment, the refrigerant path W includes parallel flow paths, a first path with a check valve 239 that allows flow upwardly (from the perspective of schematic FIGS. 10 and 11) from the inner heat exchanger 300 to the second heat exchange assembly 50/150, but prevents flow downwardly (from the perspective of schematic FIGS. 10 and 11) from the second heat exchange assembly 50/150 to the inside heat exchanger 300. A second flow path is provided from the intermediate heat exchanger 110 via a second check valve 339 and to the expansion valve 38. The second check valve 339 allows flow in the downward direction (from the schematic perspective of FIGS. 10 and 11) from the intermediate heat exchanger 110 to the expansion valve 38, but does not allow flow in the opposite direction. Accordingly, in the heating mode, refrigerant leaving the inside heat exchanger 300 bypasses the intermediate heat exchanger via the line with check valve 239 and flows to the plurality of tubes 80, 180. In the cooling mode, refrigerant leaving the plurality of tubes 80, 180 flows through the intermediate heat exchanger 110 (via flow ports 116, 118) and flows through the second check valve 339 and to the expansion valve 38. The flow of refrigerant through the intermediate heat exchanger 110 via ports 116, 118 provides some heat to refrigerant flow through the intermediate heat exchanger 110 via ports 112, 114 before that flow reaches the compressor 32. In other embodiments, the embodiment of FIGS. 10, 11 could be modified by including flow control valves (such as solenoid valves) in portion W (instead of check valves) that would selectively open and close to allow flow through the intermediate heat exchanger 110 as discussed above.

The term "about" is specifically defined herein to include a range that includes the reference value and plus or minus 5% of the reference value. The term "substantially the same" is satisfied when the width of the end surfaces of the holes are both within the above range.

While the preferred embodiments of the disclosed have been described, it should be understood that the invention is not so limited and modifications may be made without departing from the disclosure. The scope of the disclosure is defined by the appended claims, and all devices that come within the meaning of the claims, either literally or by equivalence, are intended to be embraced therein.

The specification as contemplated by the applicant can be best understood with reference to the following representative paragraphs:

Representative Paragraph 1: A heat exchanger comprising:

an assembly comprising a first set of tubes that are arranged in a parallel flow manner between a first manifold to a second manifold, wherein central straight portions of adjacent tubes within the first set of tubes are disposed with a space therebetween along each tube of the first set of tube between the first and second manifolds;

the assembly comprises a second set of tubes that are arranged in a parallel flow manner between a third manifold to a fourth manifold, wherein central straight portions of adjacent tubes within the second set of tubes are at least partially disposed within the space between adjacent tubes of the first set of tubes;

wherein a fluid that flows through the first set of tubes additionally flows through the second set of tubes before the fluid returns to again flow through the first set of tubes.

Representative Paragraph 2: The heat exchanger of Representative Paragraph 1, wherein the tubes within the first set of tubes each are straight along their length, and each of the tubes within the second set of tubes include a bent portion along their length.

Representative Paragraph 3: The heat exchanger of Representative Paragraph 2, wherein the third manifold is offset from the first manifold such that a first line through a centerline of the first manifold and through a centerline of the third manifold is disposed at an acute or perpendicular angle to a second line that extends between the centerline of the first manifold and a centerline of the second manifold.

Representative Paragraph 4: The heat exchanger of Representative Paragraph 3, wherein the first line is disposed at an acute angle to the second line.

Representative Paragraph 5: The heat exchanger either of Representative Paragraphs 3 or 4, wherein the fourth manifold is offset from the second manifold such that a third line through a centerline of the second manifold and through a centerline of the fourth manifold is disposed at an acute or a perpendicular mangle to the second line that extends between the centerline of the first manifold and the centerline of the second manifold.

Representative Paragraph 6: The heat exchanger of Representative Paragraph 5 wherein the third line is disposed at an acute angle to the second line.

Representative Paragraph 7: The heat exchanger of any one of the preceding Representative Paragraphs, wherein in a first mode of operation of the heat exchanger refrigerant flows through the first set of tubes from the first manifold to the second manifold and flows through the second set of tubes from the third manifold to the fourth manifold.

Representative Paragraph 8: The heat exchanger of Representative Paragraphs 1-6, wherein in a first mode of operation of the heat exchanger refrigerant flows through the first set of tubes from the first manifold to the second manifold and flows through the second tubes from the fourth manifold to the third manifold.

Representative Paragraph 9: The heat exchanger of Representative Paragraphs 1, 7, or 8, wherein each of the tubes within the first set of tubes includes the straight portion along its length and a curved portion along its length, wherein the straight portion of each of the tubes within the first set of tubes is fixed to the first manifold and the curved portion of each of the tubes within the first set of tubes is fixed to the second manifold.

Representative Paragraph 10: The heat exchanger of Representative Paragraph 1, wherein the third manifold is offset from the first manifold such that a first line through a centerline of the first manifold and through a centerline of the third manifold is disposed at an acute or perpendicular angle to a second line that extends between the centerline of the first manifold and a centerline of the fourth manifold.

Representative Paragraph 11: The heat exchanger of Representative Paragraph 10, wherein the first line is disposed at an acute angle to the second line.

Representative Paragraph 12: The heat exchanger of Representative Paragraph 10, wherein the second manifold is offset from the fourth manifold such that a third line through a centerline of the second manifold and through a centerline of the fourth manifold is disposed at an acute or a perpendicular mangle to the second line that extends between the centerline of the first manifold and the centerline of the fourth manifold.

Representative Paragraph 13: The heat exchanger of any one of Representative Paragraphs 9-12, wherein each of the tubes within the second set of tubes includes the straight portion along their length and a curved portion along their length, wherein the curved portion of each of the tubes within the second set of tubes is fixed to the third manifold and the straight portion of each of the tubes within the second set of tubes is fixed to the fourth manifold.

Representative Paragraph 14: The heat exchanger of Representative Paragraph 13, wherein each of the tubes of the first set of tubes and each of the tubes within the second set of tubes are formed with the same geometry and size.

Representative Paragraph 14.1: The heat exchanger of Representative Paragraph 13, wherein the curved portion of each of the tubes of the second set extend away from the straight portion with vector components in right and left directions that are opposite from a shape of the curved portion that extends from the straight portion in each of the tubes within the first set of tubes, wherein the right and left directions face out from the respective right and left sides of the tube along the straight portion of the respective tubes within the first and second sets of tubes.

Representative Paragraph 15: The heat exchanger of any one of Representative Paragraphs 1-14.1, wherein a plurality of fins are disposed between each tube of the first set of tubes and an adjacent tube of the second set of tubes, and wherein each fin is fixed to one or both tubes.

Representative Paragraph 16: The heat exchanger of any one of Representative Paragraphs 1-15, wherein refrigerant flows through the first set of tubes and then flows through an expansion valve before flowing through the second set of tubes.

Representative Paragraph 17: The heat exchanger of any one of Representative Paragraphs 1-16, wherein refrigerant flows past the second set of tubes and the first set of tubes in series.

Representative Paragraph 18: The heat exchanger any one of Representative Paragraphs 1-17, further comprising one or more flow control valves that direct whether refrigerant flows through the first set of tubes from the first manifold to the second manifold, or in another configuration refrigerant flows through the first set of tubes from the second manifold to the first manifold.

Representative Paragraph 19: The heat exchanger of Representative Paragraph 18, wherein the one or more flow control valves are operated by a controller to control the mode of operation of the heat exchanger from a cooling mode when in the first mode to a heating mode when in the second mode.

Representative Paragraph 20: The heat exchanger of Representative Paragraph 18, wherein in one mode of operation of the one or more flow control valves, refrigerant leaving the first set of tubes flows through an expansion valve before flowing through the second set of tubes.

Representative Paragraph 21: The heat exchanger of any one of Representative Paragraphs 1-20, wherein the assembly is configured to be disposed in an outdoor space that is configured for outside air to flow therethrough.

Representative Paragraph 22: The heat exchanger of any one of Representative Paragraphs 9-14, wherein the straight portion of each of the first and second sets of tubes includes top and bottom walls and right and left side walls that all are uniform along the straight portion, wherein the right and left side walls are wider than a width of the top and bottom walls, wherein a line extends through the straight portion and parallel to the right and left side walls, wherein the curved portion extends from an end of the straight portion and is shaped such that different portions of the curved portion extend away from the line in opposite right and left directions from the line.

Representative Paragraph 23: The heat exchanger of Representative Paragraph 22, wherein the curved portion of the first set of tubes is oriented such that a first portion of the curved portion extends a maximum distance in the right direction from the line, and a second portion of the curved portion extends from the first portion about the same distance from the line in the left direction as the first portion extends in the right direction.

Representative Paragraph 24: The heat exchanger of Representative Paragraph 23, wherein an end of the curved portion of each of the tubes that is fixed to second manifold extends at the maximum right distance from the line, and an end of the of the curved portion of each of the tubes that is fixed to the fourth manifold extends at the maximum left distance from the line.

Representative Paragraph 25: The heat exchanger of Representative Paragraph 24, wherein the straight portions of each of the tubes are disposed within the assembly such that each straight portion is disposed at approximately the same distance from the straight portion of the adjacent tube.

Representative Paragraph 26: A heat exchange system comprising the heat exchanger of any one of Representative Paragraphs 1-25:

wherein the heat exchanger is configured to be disposed in an outdoor space configured for outside air to flow therethrough;

further comprising a second heat exchanger that is disposed within an interior space, wherein an inlet of the second heat exchanger receives refrigerant that has flowed through both the first set of tubes and the second set of tubes, and an outlet of the second heat exchanger directs flow through the first and second set of tubes before the flow again returns to the second heat exchanger via the inlet, and a compressor disposed in the outdoor space, and an expansion valve.

Representative Paragraph 27: The heat exchange system of Representative Paragraph 26, wherein the each of the tubes within the first set of tubes includes the straight portion along their length and a curved portion along their length, wherein the straight portion of each of the tubes within the first set of tubes is fixed to the first manifold and the curved portion of each of the tubes within the first set of tubes is fixed to the second manifold, and wherein each of the tubes within the second set of tubes includes the straight portion along their length and a curved portion along their length, wherein the curved portion of each of the tubes within the second set of tubes is fixed to the third manifold and the straight portion of each of the tubes within the second set of tubes is fixed to the fourth manifold.

Representative Paragraph 28: The heat exchange system of either of Representative Paragraphs 26 or 27, wherein each of the tubes of the first set of tubes and each of the tubes within the second set of tubes are formed with the same geometry and size.

Representative Paragraph 28.1: The heat exchange system of either of Representative Paragraphs 26 or 27, wherein the curved portion of each of the tubes of the second set extend away from the straight portion with vector components in right and left directions that are opposite from a shape of the curved portion that extends from the straight portion in each of the tubes within the first set of tubes, wherein the right and left directions face out from the respective right and left sides of the tube along the straight portion of the respective tubes within the first and second sets of tubes.

Representative Paragraph 29: The heat exchange system of Representative Paragraph 28, wherein the straight portions of each of tubes within the first and second sets of tubes are aligned such that the straight portion of all of the tubes are disposed with respective upper surfaces facing with a vector component toward the second and fourth manifolds such that the respective upper surfaces all extend substantially along a single first plane, and with the respective bottom surfaces facing with a vector component away from the second and fourth manifolds such that the respective bottom surfaces all extend substantially along a single second plane, which is parallel to the first plane.

Representative Paragraph 30: The heat exchange system of either of Representative Paragraphs 28 or 29, wherein the third manifold is offset from the first manifold such that a first line through a centerline of the first manifold and through a centerline of the third manifold is disposed at an acute or perpendicular angle to a second line that extends between the centerline of the first manifold and a centerline of the second manifold.

Representative Paragraph 31: The heat exchange system of any one of Representative Paragraphs 26-30, wherein the expansion valve that is disposed in the outdoor space and disposed such that in a mode where refrigerant flowing through the first heat exchanger assembly flows through the first and second sets of tubes before reaching the compressor, refrigerant that when initially reaches the first heat exchanger assembly flows through the first set of tubes and the first and second manifolds and then flows through the expansion valve before flowing through the second set of tubes and the third and fourth manifolds Representative Paragraph 32: The heat exchange system of any one of Representative Paragraphs 26-30, wherein the expansion valve is first and second expansion valves, wherein a first expansion valve is disposed in a flow path between the first and second sets of tubes and between, and the second expansion valve is disposed proximate to an outlet of the second heat exchanger, wherein refrigerant flows through the first expansion valve and does not flow through the second expansion valve when the heat exchange system is operated to provide a heat input to the second heat exchanger, and wherein refrigerant flows through the second expansion valve and does not flow through the first expansion valve when the heat exchange system is operated to remove heat from the second heat exchanger.

Representative Paragraph 33: The heat exchange system of Representative Paragraph 32, wherein a first check valve is provided to establish a flow path to bypass the first expansion valve, and a second check valve is provided to establish a flow path to bypass the second expansion valve, wherein the first and second check valves are oriented such that when refrigerant flow is directed to flow through the respective first or second expansion valve the respective check valve prevents refrigerant flow past the respective check valve, and wherein when refrigerant flow is directed to flow in an opposite direction of flow through the respective first or second expansion valve the respective check valve allows refrigerant flow past the respective check valve.

Representative Paragraph 34: The heat exchange system of Representative Paragraph 31, wherein the expansion valve is fluidly connected such that an outlet of the expansion valve flows through a repositionable four way valve, wherein the repositionable four way valve has a direct refrigerant connection with the second heat exchanger.

Representative Paragraph 35: The heat exchange system of any one of Representative Paragraphs 26-34, wherein the first heat exchange assembly and the second heat exchanger are arranged such that in a first configuration the second heat exchanger operates as a condenser, and the first heat exchange assembly operates as an evaporator, and such that in a second configuration the second heat exchanger operates as an evaporator and the first heat exchange assembly operates as an condenser.

Representative Paragraph 36: A flat tube usable within a heat exchanger of any one of Representative Paragraphs 26-35 and to replace the tubes described in any one of these Representative Paragraphs, comprising a tube body delimiting at least one coolant channel for a coolant or a refrigerant, the tube body having an outer top surface and an outer bottom surface arranged opposite one another at a thickness (T) of the tube body and having two outer side surfaces arranged opposite one another at a width (W) of the tube body, the outer side surfaces connecting the outer top to the outer bottom surface, wherein the tube body has a heat exchange portion extending along an extension direction, wherein the tube body has an angled portion extending along an transverse direction that is inclined with respect to the extension direction, wherein the tube body has a bent portion connecting the heat exchange portion to the angled portion, wherein the angled portion is arranged at a distance (D) from the heat exchange portion measured in an offset direction perpendicular to both the extension and the transverse direction, wherein the bent portion has a first end region facing the heat exchange portion with a first bend counter to the offset direction, and a second end region facing the angled portion with a second bend in the offset direction.

Representative Paragraph 37: The flat tube according to Representative Paragraph 36, wherein the second bend is a twist-bend.

Representative Paragraph 38: The flat tube according to either one of Representative Paragraphs 36-37, wherein the extension direction follows a straight line.

Representative Paragraph 39: The flat tube according to any one of Representative Paragraphs 36-38, wherein the transverse direction is perpendicular to the extension direction.

Representative Paragraph 40: The flat tube according to any one of Representative Paragraphs 36-39, wherein the distance (D) at which the angled portion is arranged opposite the heat exchange portion is smaller than a minimum bending radius (R) of the second bend, wherein the minimum bending radius is determined by measurement of an inner height (H) of the bent portion.

Representative Paragraph 41: The flat tube according to Representative Paragraph 40, wherein the minimum bending radius (R) of the second bend is 3 to 6 times the tube thickness (T).

Representative Paragraph 42: The flat tube according to any one of Representative Paragraphs 36-41, wherein the tube body delimits numerous coolant channels arranged in a queue along the width (W) of the tube, wherein directly adjacent coolant channels are separated by a division wall extending along the thickness (T) of the tube body.

Representative Paragraph 43: The flat tube according to any one of the preceding Representative Paragraphs, wherein the tube body comprises a uniform metal material.

Representative Paragraph 44: The flat tube according to any one of Representative Paragraphs 36-43, wherein the first bend comprises two sub-bends, one of which is directed against and one of which is directed in the offset direction, such that the two sub-bends together cause the tube body to withdraw counter to the offset direction while distancing from the heat exchange portion in the extension direction, wherein the second bend has a minimum bending radius that is 0.70 to 0.95 times the width (W) of the tube body.

Representative Paragraph 44.1: The flat tube according to any one of Representative Paragraphs 36-44, wherein the bent portion in a view perpendicular both to the extension and to the offset direction has an S- or Z-like geometry.

Representative Paragraph 44.2: The flat tube of Representative Paragraph 44, wherein the bent portion in a view perpendicular both to the extension and the offset directions has a geometry that comprises an S or Z shape.

Representative Paragraph 45: A heat exchanger, comprising: a first manifold, a second manifold, a third manifold, and a fourth manifold; first flat tubes that extend between the first and second manifolds or the third and fourth manifolds, each of which has a tube body delimiting at least one coolant channel for a coolant or a refrigerant, the tube body having an outer top surface and an outer bottom surface arranged opposite one another at a thickness of the tube body and having two outer side surfaces arranged opposite one another at a width of the tube body, the outer side surfaces connecting the outer top to the outer bottom surface, wherein the tube body has a heat exchange portion extending along an extension direction, wherein the tube body has an angled portion extending along an transverse direction that is inclined with respect to the extension direction, wherein the tube body has a bent portion connecting the heat exchange portion to the angled portion, wherein the angled portion is arranged at a distance (D) from the heat exchange portion measured in an offset direction perpendicular to both the extension and the transverse direction, wherein the bent portion has a first end region facing the heat exchange portion with a first bend counter to the offset direction, and a second end region facing the angled portion with a second bend in the offset direction, wherein first longitudinal ends of the heat exchange portions facing away from the bent portions are received in associated first openings of the first collector and second longitudinal ends of the angled portions facing away from the bent portions are received in associated second openings of the second collector; second flat tubes, wherein first longitudinal ends of the second flat tubes are received in associated third openings of the third collector and second longitudinal ends of the second flat tubes, which are arranged opposite the first longitudinal ends, are received in associated fourth openings of the first collector; wherein the first and fourth openings are arranged spaced apart from one another.

Representative Paragraph 45.1: The heat exchanger according to Representative Paragraph 45, wherein the bent portion in a view perpendicular both to the extension and offset directions has a geometry that comprises an S or Z shape.

Representative Paragraph 45.2: The heat exchanger according to Representative Paragraph 45, wherein the first bend comprises two sub-bends, one of which is directed against and one of which is directed in the offset direction, such that the two sub-bends together cause the tube body to withdraw counter to the offset direction while distancing from the heat exchange portion in the extension direction, wherein the second bend has a minimum bending radius that is 0.70 to 0.95 times the width (W) of the tube body.

Representative Paragraph 46: The heat exchanger according to any one of Representative Paragraphs 45 or 45.2, wherein the first flat tubes and the second flat tubes (31) are arranged alternatingly along a stacking direction that corresponds to the offset direction of the first flat tubes.

Representative Paragraph 47: The heat exchanger according to Representative Paragraph 46, wherein in a view along the stacking direction, the heat exchange portions of the first flat tubes completely overlap the second flat tubes, whereas the angled portions of the first flat tubes do not.

Representative Paragraph 48: The heat exchanger according to any one of Representative Paragraphs 45-47, wherein between adjacent flat tubes an intermediate space (35) is present, in which heat transfer fins are accommodated.

Representative Paragraph 49: The heat exchanger according to any one of Representative Paragraph 45-48, wherein the second flat tubes are straight.

Representative Paragraph 50: The heat exchanger according to any one of Representative Paragraphs 45 to 45.2, wherein each of the second flat tubes has a tube body delimiting at least one coolant channel for a coolant or a refrigerant, the tube body having an outer top surface and an outer bottom surface arranged opposite one another at a thickness (T) of the tube body and having two outer side surfaces arranged opposite one another at a width (W) of the tube body, the outer side surfaces connecting the outer top to the outer bottom surface, wherein the tube body has a heat exchange portion extending along an extension direction, wherein the tube body has an angled portion extending along an transverse direction that is inclined with respect to the extension direction, wherein the tube body has a bent portion connecting the heat exchange portion to the angled portion, wherein the angled portion is arranged at a distance (D) from the heat exchange portion measured in an offset direction perpendicular to both the extension and the transverse direction, wherein the bent portion has a first end region facing the heat exchange portion with a first bend counter to the offset direction, and a second end region facing the angled portion with a second bend in the offset direction, wherein the transverse direction of the first flat tubes differs from the transverse direction of the second flat tubes.

Representative Paragraph 51: The heat exchanger of Representative Paragraph 16, wherein the assembly is configured to be disposed in an outdoor space that is configured for outside air to flow therethrough, wherein when refrigerant flows through the first set of tubes before flowing through the expansion valve the first set of tubes acts to condense the refrigerant flowing therethrough, and wherein when refrigerant flowing through the second set of tubes after flowing through the expansion valve the second set of tubes acts to evaporate the refrigerant flowing therethrough.

Representative Paragraph 52: The heat exchange system of Representative Paragraph 31, wherein the first heat exchange assembly is configured such that when refrigerant flows through the first set of tubes before flowing through the expansion valve the first set of tubes acts to condense the refrigerant flowing therethrough, and wherein when refrigerant flowing through the second set of tubes after flowing through the expansion valve the second set of tubes acts to evaporate the refrigerant flowing therethrough.

The invenion claimed is:

1. A heat exchanger comprising:

an assembly comprising a first set of tubes that are arranged in a parallel flow manner between a first manifold and a second manifold, wherein central straight portions of adjacent tubes within the first set of tubes are disposed with a space therebetween along each tube of the first set of tube between the first and second manifolds;

the assembly comprises a second set of tubes that are arranged in a parallel flow manner between a third manifold and a fourth manifold, wherein central straight portions of adjacent tubes within the second set of tubes are at least partially disposed within the space between adjacent tubes of the first set of tubes;

wherein a fluid that flows through the first set of tubes additionally flows through the second set of tubes before the fluid returns to again flow through the first set of tubes, wherein each of the tubes within the first set of tubes includes the straight portion along its length and a curved portion along its length, wherein the straight portion of each of the tubes within the first set of tubes is fixed to the first manifold and the curved portion of each of the tubes within the first set of tubes is fixed to the second manifold, and wherein each of the tubes within the second set of tubes includes the straight portion along their length and a curved portion along their length, wherein the curved portion of each of the tubes within the second set of tubes is fixed to the third manifold and the straight portion of each of the tubes within the second set of tubes is fixed to the fourth manifold, wherein the curved portion of each of the tubes of the second set extend away from the straight portion with vector components in right and left directions that are opposite from a shape of the curved portion that extends from the straight portion in each of the tubes within the first set of tubes, wherein the right and left directions face out from the respective right and left sides of the tube along the straight portion of the respective tubes within the first and second sets of tubes.

2. The heat exchanger of claim 1, wherein the third manifold is offset from the first manifold such that a first line through a centerline of the first manifold and through a centerline of the third manifold is disposed at an acute angle to a second line that extends between the centerline of the first manifold and a centerline of the fourth manifold, and wherein the second manifold is offset from the fourth manifold such that a third line through a centerline of the second manifold and through a centerline of the fourth manifold is disposed at an acute angle to the second line that extends between the centerline of the first manifold and the centerline of the fourth manifold.

3. The heat exchanger of claim 1, wherein each of the tubes of the first set of tubes and each of the tubes within the second set of tubes are formed with the same geometry and size.

4. The heat exchanger of claim 1, wherein a plurality of fins are disposed between each tube of the first set of tubes and an adjacent tube of the second set of tubes, and wherein each fin is fixed to one or both tubes.

5. The heat exchanger of claim 1, wherein refrigerant flows through the first set of tubes and then flows through an expansion valve before flowing through the second set of tubes.

6. The heat exchanger of claim 1, wherein refrigerant flows past the first set of tubes and the second set of tubes in series.

7. The heat exchanger of claim 1, wherein the assembly is configured to be disposed in an outdoor space that is configured for outside air to flow therethrough.

8. The heat exchanger of claim 5, wherein the assembly is configured to be disposed in an outdoor space that is configured for outside air to flow therethrough, wherein when refrigerant flows through the first set of tubes before flowing through the expansion valve the first set of tubes acts to condense the refrigerant flowing therethrough, and wherein when refrigerant flowing through the second set of tubes after flowing through the expansion valve the second set of tubes acts to evaporate the refrigerant flowing therethrough.

9. A heat exchanger comprising:

an assembly comprising a first set of tubes that are arranged in a parallel flow manner between a first manifold and a second manifold, wherein central straight portions of adjacent tubes within the first set of tubes are disposed with a space therebetween along each tube of the first set of tube between the first and second manifolds;

the assembly comprises a second set of tubes that are arranged in a parallel flow manner between a third manifold and a fourth manifold, wherein central straight portions of adjacent tubes within the second set of tubes are at least partially disposed within the space between adjacent tubes of the first set of tubes;

wherein a fluid that flows through the first set of tubes additionally flows through the second set of tubes before the fluid returns to again flow through the first set of tubes, wherein each of the tubes within the first set of tubes includes the straight portion along its length and a curved portion along its length, wherein the straight portion of each of the tubes within the first set of tubes is fixed to the first manifold and the curved portion of each of the tubes within the first set of tubes is fixed to the second manifold, and wherein each of the tubes within the second set of tubes includes the straight portion along their length and a curved portion along their length, wherein the curved portion of each of the tubes within the second set of tubes is fixed to the third manifold and the straight portion of each of the tubes within the second set of tubes is fixed to the fourth manifold wherein the straight portion of each of the first and second tubes includes top and bottom walls and right and left side walls that all are uniform along the straight portion, wherein the right and left side walls are wider than a width of the top and bottom walls, wherein a line extends through the straight portion and parallel to the right and left side walls, wherein the curved portion extends from an end of the straight portion and is shaped such that different portions of the curved portion extend away from the line in opposite right and left directions from the line.

10. The heat exchanger of claim 9, wherein the curved portion of the first set of tubes is oriented such that a first portion of the curved portion extends a maximum distance in the right direction from the line, and a second portion of the curved portion extends from the first portion about the same distance from the line in the left direction as the first portion extends in the right direction.

11. The heat exchanger of claim 10, wherein the straight portions of each of the tubes are disposed within the assembly such that each straight portion is disposed at approximately the same distance from the straight portion of the adjacent tube.

12. The heat exchanger of claim 9, wherein the third manifold is offset from the first manifold such that a first line through a centerline of the first manifold and through a centerline of the third manifold is disposed at an acute angle to a second line that extends between the centerline of the first manifold and a centerline of the fourth manifold, and wherein the second manifold is offset from the fourth manifold such that a third line through a centerline of the second manifold and through a centerline of the fourth manifold is disposed at an acute angle to the second line that extends between the centerline of the first manifold and the centerline of the fourth manifold.

13. The heat exchanger of claim 9, wherein each of the tubes of the first set of tubes and each of the tubes within the second set of tubes are formed with the same geometry and size.

14. The heat exchange of claim 9, wherein the curved portion of each of the tubes of the second set extend away from the straight portion with vector components in right and left directions that are opposite from a shape of the curved portion that extends from the straight portion in each of the tubes within the first set of tubes, wherein the right and left directions face out from the respective right and left sides of the tube along the straight portion of the respective tubes within the first and second sets of tubes.

15. The heat exchanger of claim 9, wherein a plurality of fins are disposed between each tube of the first set of tubes and an adjacent tube of the second set of tubes, and wherein each fin is fixed to one or both tubes.

16. The heat exchanger of claim 9, wherein refrigerant flows through the first set of tubes and then flows through an expansion valve before flowing through the second set of tubes.

17. The heat exchanger of claim 9, wherein refrigerant flows past the first set of tubes and the second set of tubes in series.

18. The heat exchanger of claim 9, wherein the assembly is configured to be disposed in an outdoor space that is configured for outside air to flow therethrough.

19. A heat exchange system comprising:

a first heat exchange assembly that is configured to be disposed in an outdoor space configured for outside air to flow therethrough, the first heat exchange assembly comprising:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

a second heat exchanger that is disposed within an interior space, wherein an inlet of the second heat exchanger receives refrigerant that has flowed through both the first set of tubes and the second set of tubes, and an outlet of the second heat exchanger directs flow through the first and second set of tubes before the flow again returns to the second heat exchanger via the inlet, wherein each of the tubes within the first set of tubes includes the straight portion along their length and a curved portion along their length, wherein the straight portion of each of the tubes within the first set of tubes is fixed to the first manifold and the curved portion of each of the tubes within the first set of tubes is fixed to the second manifold, and wherein each of the tubes within the second set of tubes includes the straight portion along their length and a curved portion along their length, wherein the curved portion of each of the tubes within the second set of tubes is fixed to the third manifold and the straight portion of each of the tubes within the second set of tubes is fixed to the fourth manifold;

a compressor disposed in the outdoor space, and an expansion valve, wherein the curved portion of each of the tubes of the second set extend away from the straight portion with vector components in right and left directions that are opposite from a shape of the curved portion that extends from the straight portion in each of the tubes within the first set of tubes, wherein the right and left directions face out from the respective right and left sides of the tube along the straight portion of the respective tubes within the first and second sets of tubes.

20. The heat exchange system of claim 19, wherein each of the tubes of the first set of tubes and each of the tubes within the second set of tubes are formed with the same geometry and size.

21. The heat exchange system of claim 19, wherein the third manifold is offset from the first manifold such that a first line through a centerline of the first manifold and through a centerline of the third manifold is disposed at an acute or perpendicular angle to a second line that extends between the centerline of the first manifold and a centerline of the second manifold.

22. The heat exchange system of claim 19, wherein the expansion valve that is disposed in the outdoor space and disposed such that in a mode where refrigerant flowing through the first heat exchanger assembly flows through the first and second sets of tubes before reaching the compressor, refrigerant that when initially reaches the first heat exchanger assembly flows through the first set of tubes and the first and second manifolds and then flows through the expansion valve before flowing through the second set of tubes and the third and fourth manifolds.

23. The heat exchange system of claim 22, wherein the first heat exchange assembly is configured such that when refrigerant flows through the first set of tubes before flowing through the expansion valve the first set of tubes acts to condense the refrigerant flowing therethrough, and wherein when refrigerant flowing through the second set of tubes after flowing through the expansion valve the second set of tubes acts to evaporate the refrigerant flowing therethrough.

24. The heat exchange system of claim 22, wherein the expansion valve is fluidly connected such that an outlet of the expansion valve flows through a repositionable four way valve, wherein the repositionable four way valve has a direct refrigerant connection with the second heat exchanger.

25. The heat exchange system of claim 19, wherein the first heat exchange assembly and the second heat exchanger are arranged such that in a first configuration the second heat exchanger operates as a condenser, and the first heat exchange assembly operates as an evaporator, and such that in a second configuration the second heat exchanger operates as an evaporator and the first heat exchange assembly operates as an condenser.

26. A heat exchange system comprising:

a first heat exchange assembly that is configured to be disposed in an outdoor space configured for outside air to flow therethrough, the first heat exchange assembly comprising:

a first set of tubes that are arranged in a parallel flow manner between a first manifold and a second manifold, wherein straight portions of adjacent tubes within the first set of tubes are disposed with a space therebetween along each tube of the first set of tube between the first and second manifolds;

a second set of tubes that are arranged in a parallel flow manner between a third manifold and a fourth manifold, wherein straight portions of adjacent tubes within the second set of tubes are at least partially disposed within the space between straight portions of adjacent tubes of the first set of tubes; wherein a refrigerant that flows through the first set of tubes additionally flows through the second set of tubes before the refrigerant returns to again flow through the first set of tubes;

a second heat exchanger that is disposed within an interior space, wherein an inlet of the second heat exchanger receives refrigerant that has flowed through both the first set of tubes and the second set of tubes, and an outlet of the second heat exchanger directs flow through the first and second set of tubes before the flow again returns to the second heat exchanger via the inlet, wherein each of the tubes within the first set of tubes includes the straight portion along their length and a curved portion along their length, wherein the straight portion of each of the tubes within the first set of tubes is fixed to the first manifold and the curved portion of each of the tubes within the first set of tubes is fixed to the second manifold, and wherein each of the tubes within the second set of tubes includes the straight portion along their length and a curved portion along their length, wherein the curved portion of each of the tubes within the second set of tubes is fixed to the third manifold and the straight portion of each of the tubes within the second set of tubes is fixed to the fourth manifold;

a compressor disposed in the outdoor space, and an expansion valve, wherein the expansion valve is first and second expansion valves, wherein a first expansion valve is disposed in a flow path between the first and second sets of tubes and between, and the second expansion valve is disposed proximate to an outlet of the second heat exchanger, wherein refrigerant flows through the first expansion valve and does not flow through the second expansion valve when the heat exchange system is operated to provide a heat input to the second heat exchanger, and wherein refrigerant flows through the second expansion valve and does not flow through the first expansion valve when the heat exchange system is operated to remove heat from the second heat exchanger.

27. The heat exchange system of claim 26, wherein a first check valve is provided to establish a flow path to bypass the first expansion valve, and a second check valve is provided to establish a flow path to bypass the second expansion valve, wherein the first and second check valves are oriented such that when refrigerant flow is directed to flow through the respective first or second expansion valve the respective check valve prevents refrigerant flow past the respective check valve, and wherein when refrigerant flow is directed to flow in an opposite direction of flow through the respective first or second expansion valve the respective check valve allows refrigerant flow past the respective check valve.

28. The heat exchange system of claim 26, wherein each of the tubes of the first set of tubes and each of the tubes within the second set of tubes are formed with the same geometry and size.

* * * * *